US007750875B2

(12) United States Patent
Kim et al.

(10) Patent No.: US 7,750,875 B2
(45) Date of Patent: Jul. 6, 2010

(54) ORGANIC LIGHT-EMITTING DIODE DISPLAY DEVICE AND DRIVING METHOD THEREOF

(75) Inventors: O Hyun Kim, Gyeongsangbuk-do (KR); Hoon Ju Chung, Geoneggi-do (KR); Myoung Hoon Jung, Seoul (KR)

(73) Assignee: LG Display Co., Ltd., Seoul (KR)

( * ) Notice: Subject to any disclaimer, the term of this patent is extended or adjusted under 35 U.S.C. 154(b) by 861 days.

(21) Appl. No.: 11/644,869

(22) Filed: Dec. 26, 2006

(65) Prior Publication Data

US 2007/0296672 A1 Dec. 27, 2007

(30) Foreign Application Priority Data

Jun. 22, 2006 (KR) ..... 10-2006-0056566

(51) Int. Cl.
*G09G 3/32* (2006.01)

(52) U.S. Cl. ..... 345/82; 345/92

(58) Field of Classification Search ..... 345/82–102, 345/204

See application file for complete search history.

(56) References Cited

U.S. PATENT DOCUMENTS 7,019,717 B2 * 3/2006 Yumoto et al. ..... 345/76
7,042,426 B2 * 5/2006 Shin ..... 345/76
7,483,004 B2 * 1/2009 Kim ..... 345/82
7,538,749 B2 * 5/2009 Chung et al. ..... 345/77
7,554,514 B2 * 6/2009 Nozawa ..... 345/82
2003/0103022 A1 * 6/2003 Noguchi et al. ..... 345/77
2005/0083270 A1 * 4/2005 Miyazawa ..... 345/76
2005/0225251 A1 * 10/2005 Hsueh ..... 315/169.2
2006/0077194 A1 * 4/2006 Jeong ..... 345/204
2008/0143648 A1 * 6/2008 Ishizuka et al. ..... 345/76
2009/0207107 A1 * 8/2009 Chung et al. ..... 345/76
2009/0303220 A1 * 12/2009 You et al. ..... 345/211

* cited by examiner

*Primary Examiner*—Nitin Patel
(74) *Attorney, Agent, or Firm*—Morgan Lewis & Bockius LLP

(57) ABSTRACT

An organic light-emitting diode display device includes a first switch element turned-on in response to a first scanning signal during a first period to supply a data to a first node, and then maintaining an off-state during a second period, a driving device adjusting a current through an organic light-emitting diode element in accordance with a voltage of the first node; a reference voltage source providing a reference voltage that is capable of turning-off the driving device, a second switch element maintaining an off-state during the first period, and turned-on during the second period to supply the reference voltage to the first node, and a storage capacitor maintaining the voltage at the first node.

34 Claims, 37 Drawing Sheets

ORGANIC LIGHT-EMITTING DIODE DISPLAY DEVICE AND DRIVING METHOD THEREOF

The invention claims the benefit of Korean Patent Application No. P06-0056566 filed in Korea on Jun. 22, 2006, which is hereby incorporated by reference in its entirety.

BACKGROUND OF THE INVENTION

1. Field of the Invention

The invention relates to an organic light-emitting diode display device, and more particularly, to an organic light-emitting diode display device and a driving method thereof. Although embodiments of the invention are suitable for a wide scope of applications, they are particularly suitable for reducing a residual image phenomenon and a motion image blurring phenomenon, and for compensating a voltage drop of a driving voltage in an organic light-emitting diode display device.

2. Discussion of the Related Art

Recently, flat display panels with reduced weight and size have been developed to eliminate disadvantages of a cathode ray tube display device. Such flat panel display devices include a liquid crystal display (hereinafter, referred to as "LCD") device, a field emission display (hereinafter, referred to as "FED") device, a plasma display panel (hereinafter, referred to as "PDP") device, and an electro-luminescence (hereinafter, referred to as "EL") display device.

In general, a PDP has been highlighted among flat panel display devices as advantageous to have light weight, a small size and a large dimension screen because its structure and manufacturing process are simple. However, a PDP has a low light-emission efficiency and requires large power consumption. Likewise, an active matrix LCD device employing a thin film transistor (hereinafter, referred to as "TFT") as a switching device has experienced drawbacks in that it is difficult to make a large dimension screen because a semiconductor process is used, but has an expanded demand as it is mainly used for a display device of a notebook personal computer. On the other hand, an EL display device is largely classified into an inorganic EL display device and an organic light-emitting diode display device depending upon a material of a light-emitting layer. An EL display device also is advantageous in that it is self-luminous. When compared with the above-mentioned display devices, the EL device generally has a faster response speed, a higher light-emission efficiency, greater brightness and a wider viewing angle.

FIG. 1 is a schematic diagram illustrating a structure of an organic light-emitting diode display device according to the related art. In FIG. 1, the organic light-emitting diode device includes an anode electrode ANODE made of a transparent conductive material on a glass substrate, and a cathode electrode CATHODE made of an organic compound layer and a conductive metal. The organic light-emitting diode device also includes an organic compound layer. The organic compound layer comprises a hole injection layer HIL, a hole transport layer HTL, an emission layer EML, an electron transport layer ETL, and an electron injection layer EIL.

When a driving voltage is applied to the anode electrode ANODE and the cathode electrode CATHODE, a hole within the hole injection layer and an electron within the electron injection layer respectively move forward the emission layer EML to excite the emission layer EML. As a result, the emission layer EML emits visible rays and the visible rays generated from the emission layer EML display a picture or a motion picture.

The above-described organic light-emitting diode device has been applied to a passive matrix type display device or to an active matrix type display using a TFT as a switching element. The passive matrix type display device crosses the anode electrode ANODE with the cathode electrode CATHODE to select a light-emitting cell in accordance with a current applied to the anode and cathode electrodes ANODE and CATHODE. On the other hand, the active matrix type display device selectively turns-on an active element, such as a TFT, to select a light-emitting cell, and maintains light-emission in the light-emitting cell using a voltage maintained at a storage capacitor.

FIG. 2 is a circuit diagram illustrating a pixel of an active matrix type organic light-emitting diode display device according to the related art. Referring to FIG. 2, a pixel of an active matrix type organic light-emitting diode display device includes an organic light-emitting diode element OLED, a data line DL and a gate line GL that cross each other, a switch TFT T2, a driving TFT T1, and a storage capacitor Cst. The driving TFT T1 and the switch TFT T2 are made of a p-type MOS-FET.

The switch TFT T2 is turned-on in response to a gate low-level voltage (or a scanning voltage) from the gate line GL to form a current path between a source electrode and a drain electrode of the switch TFT T2, and maintains an off-state when a voltage of the gate line GL is less than a threshold voltage (hereinafter, referred to as "Vth"), that is, a gate high-level voltage. A data voltage from the data line DL is applied, via the source electrode and the drain electrode of the switch TFT T2, to a gate electrode and the storage capacitor Cst of the driving TFT T1 for an on-time period of the switch TFT T2. On the other hand, a current path between the source electrode and the drain electrode of the switch TFT T2 is opened for an off-time period of the switch TFT T2. As a result, the data voltage is not applied to the driving TFT T1 and the storage capacitor Cst.

In addition, the source electrode of the driving TFT T1 is connected to a driving voltage line VL and the storage capacitor Cst, and the drain electrode of the driving TFT T1 is connected to an anode electrode of the organic light-emitting diode element OLED. The gate electrode of the driving TFT T1 is connected to the drain electrode of the switch TFT T2. The driving TFT T1 adjusts a current amount between the source electrode and the drain electrode in accordance with the data voltage supplied to the gate electrode. As a result, the organic light-emitting diode element OLED emits brightness corresponding to the data voltage. Further, the storage capacitor Cst stores a difference voltage between the data voltage and a high-level driving voltage source VDD to maintain a constant voltage applied to the gate electrode of the driving TFT T1 for one frame period.

The organic light-emitting diode element OLED shown in FIG. 2 has the structure as shown in FIG. 1, and includes an anode electrode and a cathode electrode. The anode electrode of the organic light-emitting diode element OLED is connected to the drain electrode of the driving TFT T1, and the cathode electrode of the organic light-emitting diode element OLED is connected to a ground voltage source GND.

The brightness of a pixel as shown in FIG. 2 is in proportion to a current flowing into the organic light-emitting diode element OLED, and the current is adjusted by a voltage applied to the gate electrode of the driving TFT T1. In other words, a gate-source voltage |Vgs| between a gate electrode and a source element of the driving TFT T1 must be increased in order to improve brightness of a pixel. On the other hand, the gate-source voltage |Vgs| must be decreased in order to darken brightness of a pixel.

FIG. 3A is a graph illustrating a hysteresis characteristic of a thin film transistor according to the related art, FIG. 3B is an amplified graph of a portion of the graph shown in FIG. 3A, and FIG. 4 is a graph illustrating an example which an operating point of a thin film transistor is changed in accordance with a hysteresis characteristic. The driving TFT T1 (shown in FIG. 2) has a hysteresis characteristic. As shown in FIGS. 3A and 3B, the hysteresis characteristics are generated as a current between a drain electrode and a source electrode $I_{ds}$ changes in accordance with a change of a gate-source voltage |Vgs|. For example, if brightness of a pixel is changed from a white gray scale level to a middle gray scale level, then the gate-source voltage |Vgs| of the driving TFT T1 is changed from a high value to a low value. In this case, since a relatively high gate-source voltage |Vgs| is formerly applied to the driving TFT T1 at the white gray scale level, if the gate-source voltage |Vgs| corresponding to the middle gray scale level is applied to the driving TFT T1 at a state that a threshold voltage |Vth| of the driving TFT T1 is increased, then an operating point of the driving TFT T1 is changed as shown in "B" of FIG. 4.

On the other hand, if brightness of a pixel is changed from a black gray scale level to the middle gray scale level, then the gate-source voltage |Vgs| of the driving TFT T1 is changed from a low value to a high value. In this case, since a relative low gate-source voltage |Vgs| is formerly applied to the driving TFT T1 at the black gray scale level, if a gate-source voltage |Vgs| corresponding to the middle gray scale level is applied to the driving TFT T1 at a state that a threshold voltage |Vth| of the driving TFT T1 is decreased, then an operating point of the driving TFT T1 is changed as shown in "A" of FIG. 4. Accordingly, although the same gate-source voltage |Vgs| is applied to the driving TFT T1 to represent the same brightness of the middle gray scale level, different currents would flow to the organic light-emitting diode element OLED in accordance with a prior pixel brightness. Thus, a residual image is generated.

FIG. 5A is a diagram illustrating a test data according to the related art, FIG. 5B is a diagram illustrating an example of a residual image phenomenon after the test data shown in FIG. 5A is applied to the device shown in FIG. 2. FIG. 5A illustrates a test data displayed on a display screen when no residual image is generated. The test data is to display the white gray scale level and the black gray scale level that are arranged in a check pattern corresponding to pixels that are arranged in the matrix type organic light-emitting diode display device shown in FIG. 2. As shown in FIG. 5B, when a test data is applied to the organic light-emitting diode display device, a middle gray scale level data is instead displayed on the whole screen due to the hysteresis characteristic of the driving TFT.

Moreover, an active-type organic light-emitting diode display device according to the related art has a pixel configuration including TFTs and a storage capacitor as shown in FIG. 2 and is a hold type display. The hold type display device constantly maintains brightness of each pixel for each frame for one frame period as shown in FIG. 6. Thus, brightness of each pixel for one frame period is maintained, thereby burring an image of a motion picture and causing motion blurring. On the other hand, an impulse type display device, such as a cathode ray tube, emits light from the pixel for a time of one frame period, and does not emit light from the pixel for another frame period. As a result, a motion blurring phenomenon is almost not perceived by the observer.

In the active-type organic light-emitting diode display device, a current and brightness of the organic light-emitting diode element OLED is differentiated at a data having the same gray scale level in accordance with a screen position by a voltage drop. The voltage drop is generated by a driving voltage line VL supplying the high-level electric driving voltage source to each of the pixels. This phenomenon worsens as the driving voltage line VL becomes longer in a large size panel.

SUMMARY OF THE INVENTION

Accordingly, embodiments of the invention is directed to an organic light-emitting diode display device and a driving method thereof employing the same that substantially obviate one or more of the problems due to limitations and disadvantages of the related art.

An object of embodiments of the invention is to provide an organic light-emitting diode display device and a driving method thereof that reduce display deterioration caused by a thin film transistor having a hysteresis characteristic.

Another object of embodiments of the invention is to provide an organic light-emitting diode display device and a driving method thereof that reduce a residual image phenomenon.

Another object of embodiments of the invention is to provide an organic light-emitting diode display device and a driving method thereof that reduce a motion image blurring phenomenon.

Another object of embodiments of the invention is to provide an organic light-emitting diode display device and a driving method thereof that compensate a voltage drop of a driving voltage and a ground voltage supply line.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, an organic light-emitting diode display device includes a driving voltage source providing a driving voltage, a ground voltage source providing a ground voltage, a first scan line receiving a first scanning signal, a second scan line receiving a second scanning signal, a data line crossing the first and second scan lines, a first switch element turned-on in response to the first scanning signal during a first period to supply a data from the data line to a first node, and then maintaining an off-state during a second period, a driving device adjusting a current through an organic light-emitting diode element in accordance with a voltage of the first node, a reference voltage source providing a reference voltage that is capable of turning-off the driving device, a second switch element maintaining an off-state during the first period, and turned-on during the second period to supply the reference voltage to the first node, and a storage capacitor maintaining a voltage at the first node.

In another aspect, an organic light-emitting diode display device includes a driving voltage source providing a driving voltage, a ground voltage source providing a ground voltage, an organic light-emitting diode element, a scan line receiving a first scanning signal and a second scanning signal sequentially at an interval, a data line crossing the scan line and receiving a data voltage and a reset voltage, a switch element turned-on by the first scanning signal during a first period to supply the data voltage to a first node, and then turned-on by the second scanning signal during a second period to supply the reset voltage to the first node, a driving device allowing a current to flow into the organic light-emitting diode element in accordance with the data voltage supplied to the first node and turned-off by the reset voltage supplied to the first node, and a storage capacitor maintaining the voltage at the first node.

In another aspect, an organic light-emitting diode display device includes a driving voltage source providing a driving voltage, a ground voltage source providing a ground voltage, a reference voltage source providing a reference voltage, an organic light-emitting diode element, a capacitor connected between a first node and a second node, a first scan line receiving a first scanning signal and a second scanning signal, a second scan line receiving a first scanning signal and a second scanning signal sequentially at an interval, a data line crossing the scan lines and receiving a data voltage and a reset voltage, a first a switch element turned-on by a signal of the first scan line during a first period to supply the reference voltage to the second node, and then turned-off during a second period, and turned-on by a signal of the first scan line during a third period to supply the reference voltage to the second node, a first b switch element turned-on by a signal of the first scan line during the first period to supply the data voltage to the first node, and then turned-off by a signal of the first scan line during the second period, and turned-on by a signal of the first scan line during the third period to supply the reset voltage to the first node, a driving device allowing a current to flow into the organic light-emitting diode element in accordance with the data voltage supplied to the first node, and turned-off by the reset voltage supplied to the first node, and a second switch element turned-off by a signal of the second scan line for the first period, and then turned-on for the second time to supply one of the driving voltage and the reference voltage to the second node, and turned-off for the third period.

In another aspect, a method of driving an organic light-emitting diode display device, including an organic light-emitting diode element, a driving voltage source providing a driving voltage, a ground voltage source providing a ground voltage, a driving device adjusting a current of the organic light-emitting diode element in accordance with a voltage of a first node, and to which the driving voltage is supplied via a second node, a storage capacitor connected between the first node and the second node, a data line receiving a data voltage, and a scan line crossing the data line and receiving a scanning signal, the method includes supplying a first scanning signal to a first scan line during a first period to turn-on a first switch element connected between the data line and the first node to supply the data voltage to the first node, and turning-off the first switch element, and supplying a second scanning signal to a second scan line during a second period to turn-on a second switch element connected between a reference voltage source generating a reference voltage that is capable of turning-off the driving device and the first node to supply the reference voltage to the first node.

In another aspect, a method of driving an organic light-emitting diode display device, including an organic light-emitting diode element, a driving voltage source providing a driving voltage, a ground voltage source providing a ground voltage, a driving device adjusting a current of the organic light-emitting diode element in accordance with a voltage of a first node, and to which the driving voltage is supplied via a second node, a storage capacitor connected between the first node and the second node, a data line receiving a data voltage, and a scan line crossing the data line and receiving a scanning signal, the method includes supplying the data voltage to the data line during a first period, and then supplying a reset voltage that is capable of turning-off the driving device to the data line during a second period, supplying a first scanning signal to the scan line during the first period to turn-on a first switch element connected between the data line and the first node to supply the data voltage to a first node, and supplying a second scanning signal to the scan line during the second period to supply the reset voltage to the first node.

In another aspect, a method of driving an organic light-emitting diode display device, including an organic light-emitting diode element, a driving voltage source providing a driving voltage, a ground voltage source providing a ground voltage, a driving device adjusting a current of the organic light-emitting diode element in accordance with a voltage of a first node, and to which the driving voltage is supplied via a second node, and a storage capacitor connected between the first node and the second node, the method includes sequentially supplying a data voltage, and a reset voltage that is capable of turning-off the driving device to the data line, supplying a scanning voltage of a first scanning signal to a first scan line during a first period to turn-on a first a switch element connected between a reference voltage source generating a reference voltage and the second node to charge the reference voltage into the second node and, at the same time turning-on a first b switch element connected between the data line and the first node to charge the data voltage into the first node, and supplying a non-scanned voltage of a first inversed scanning signal generated in a reverse phase against the first scanning signal to a second scan line to turn-off a second switch element connected between the driving voltage source and the second node, supplying a non-scanned voltage of the first scanning signal to the first scan line during a second period to turn-off the first a and first b switch elements and, at the same time supplying a scanning voltage of the first inversed scanning signal to the second scan line to turn-on the second switch element to supply supplying one of the driving voltage and the ground voltage to the second node, and supplying a scanning voltage of a second scanning signal to the first scan line during a third period to turn-on the first a and first b switch elements to supply the reset voltage to the first node, and supplying the reference voltage to the second node and, at the same time supplying a non-scanned voltage of a second inversed scanning signal generated in a reverse phase against the second scanning signal to the second scan line to turn-off the second switch element.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention. In the drawings.

DETAILED DESCRIPTION OF THE PREFERRED EMBODIMENTS

Reference will now be made in detail to the preferred embodiments of the invention, examples of which are illustrated in the accompanying drawings.

Figure 1:
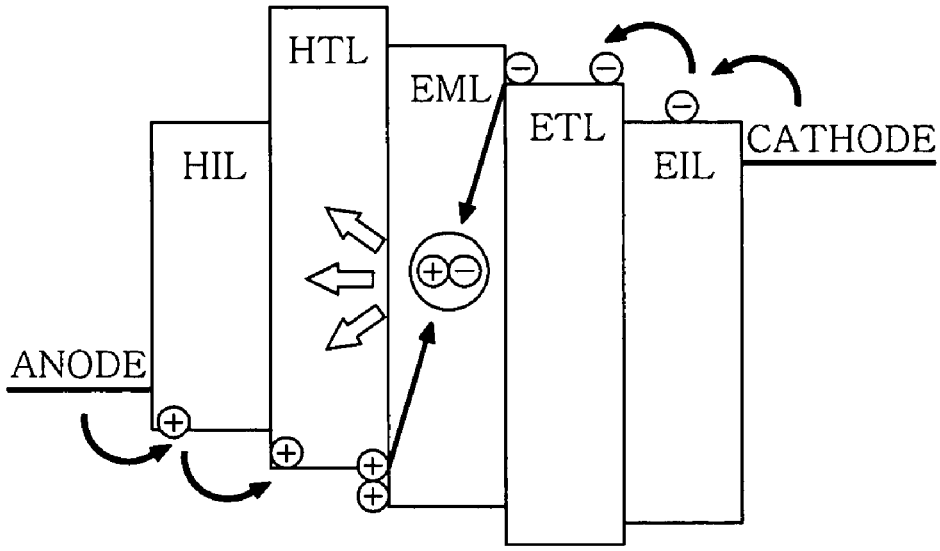
FIG. 1 RELATED ART
FIG. 1 is a schematic diagram illustrating a structure of an organic light-emitting diode display device according to the related art.
Figure 2:
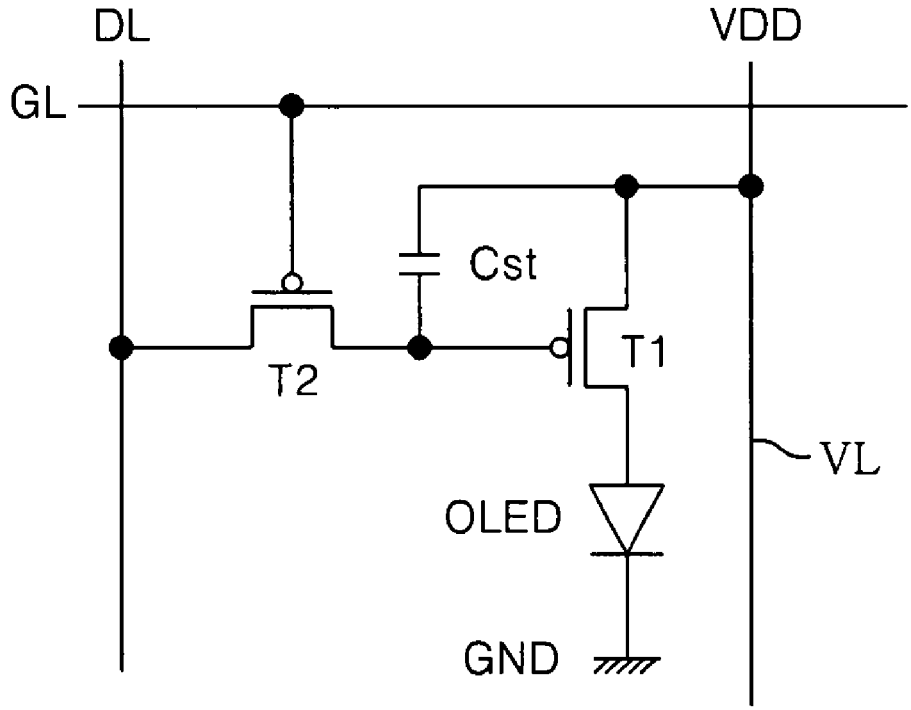
FIG. 2 RELATED ART
FIG. 2 is a circuit diagram illustrating a pixel of an active matrix type organic light-emitting diode display device according to the related art.
Figure 3A:
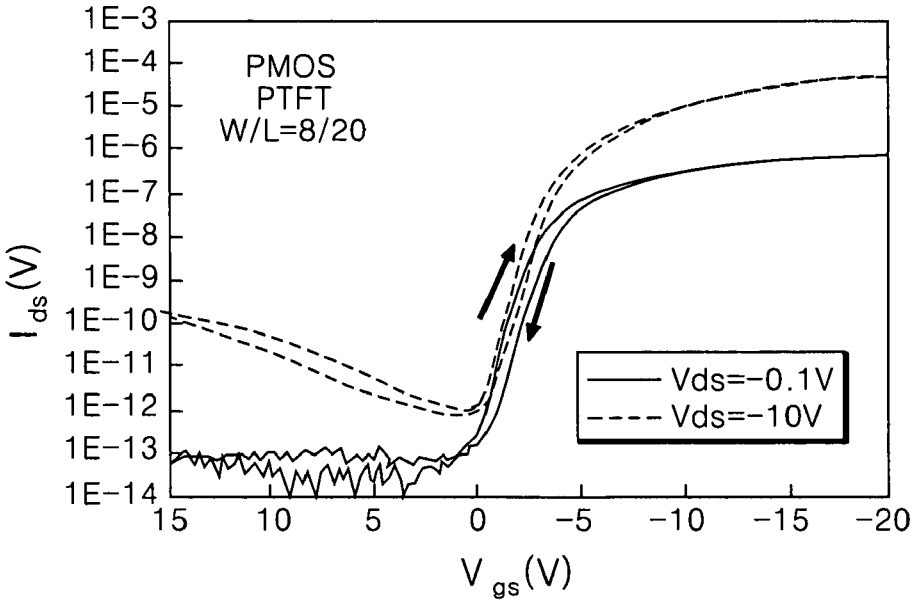
FIG.3A RELATED ART
FIG. 3A is a graph illustrating a hysteresis characteristic of a thin film transistor according to the related art.
Figure 3B:
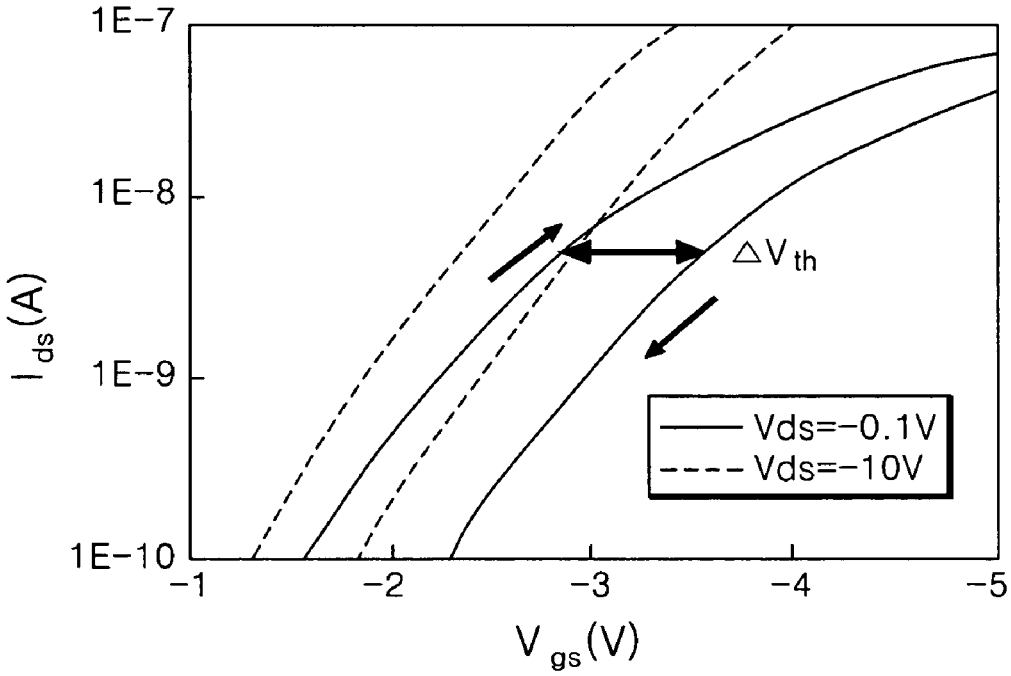
FIG.3B RELATED ART
FIG. 3B is an amplified graph of a portion of the graph shown in FIG. 3A.
Figure 4:
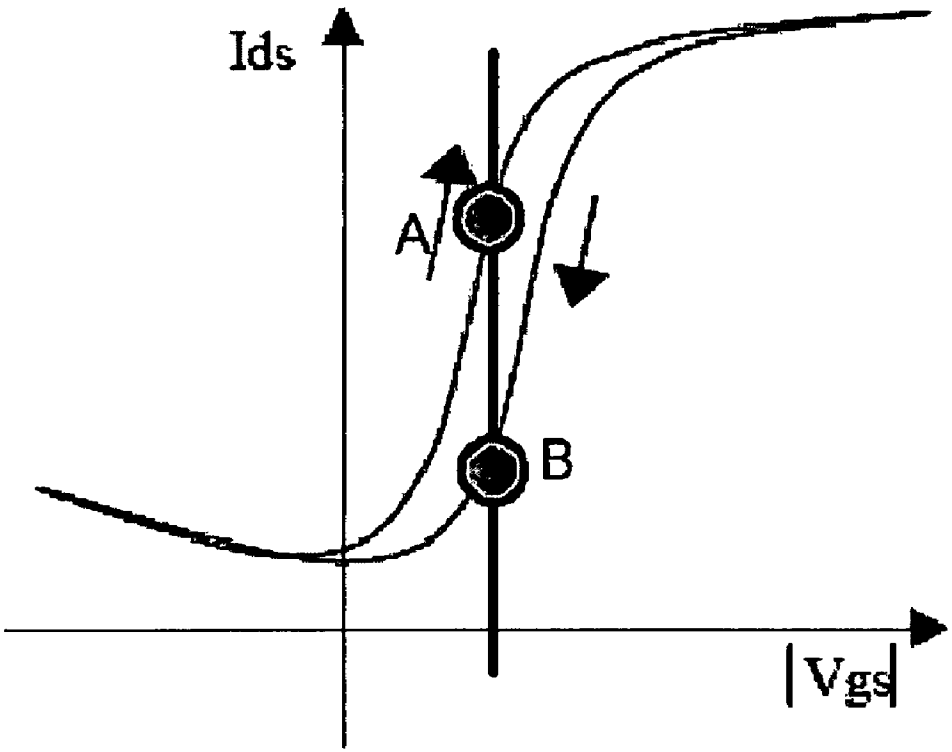
FIG. 4 RELATED ART
FIG. 4 is a graph illustrating an example which an operating point of a thin film transistor is changed in accordance with a hysteresis characteristic.
Figure 5A:
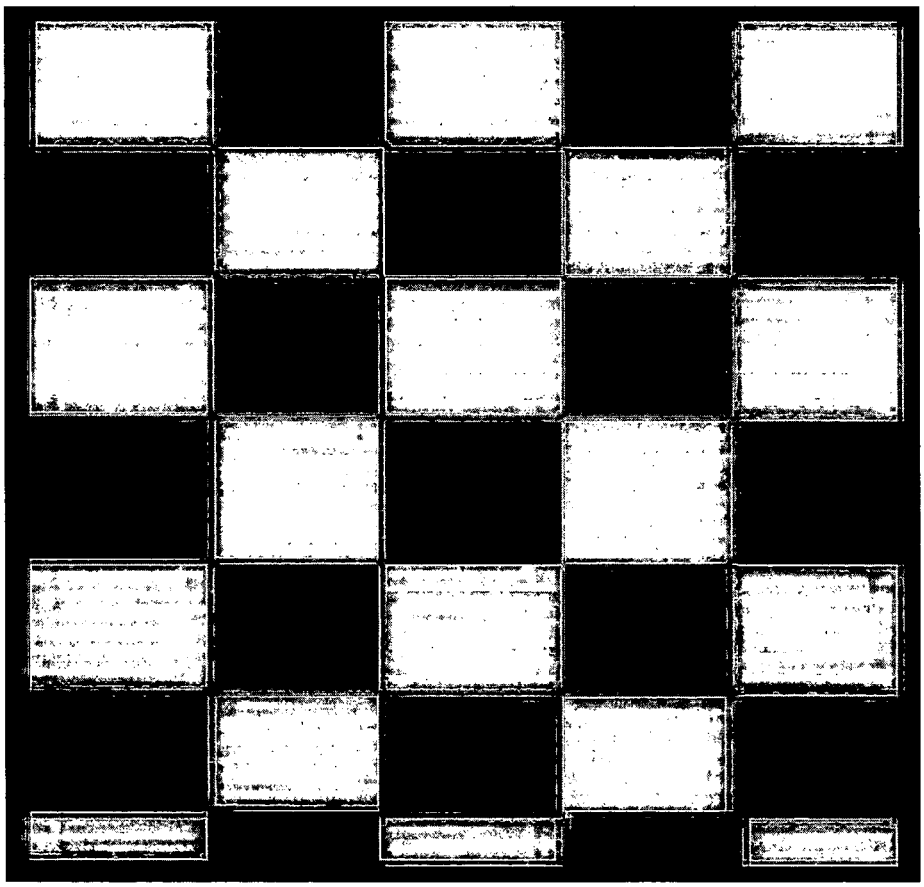
FIG.5A RELATED ART
FIG. 5A is a diagram illustrating a test data according to the related art.
Figure 5B:
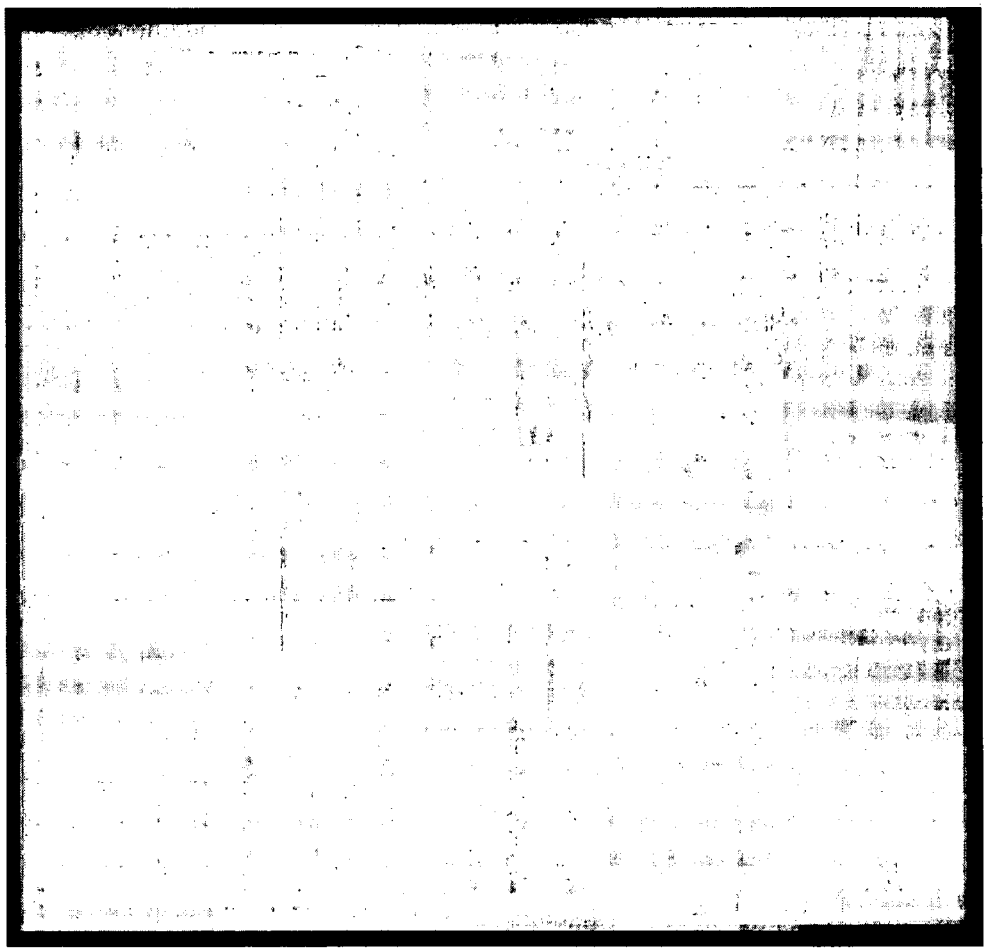
FIG.5B RELATED ART
FIG. 5B is a diagram illustrating an example of a residual image phenomenon after the test data shown in FIG. 5A is applied to the device shown in FIG. 2.
Figure 6:
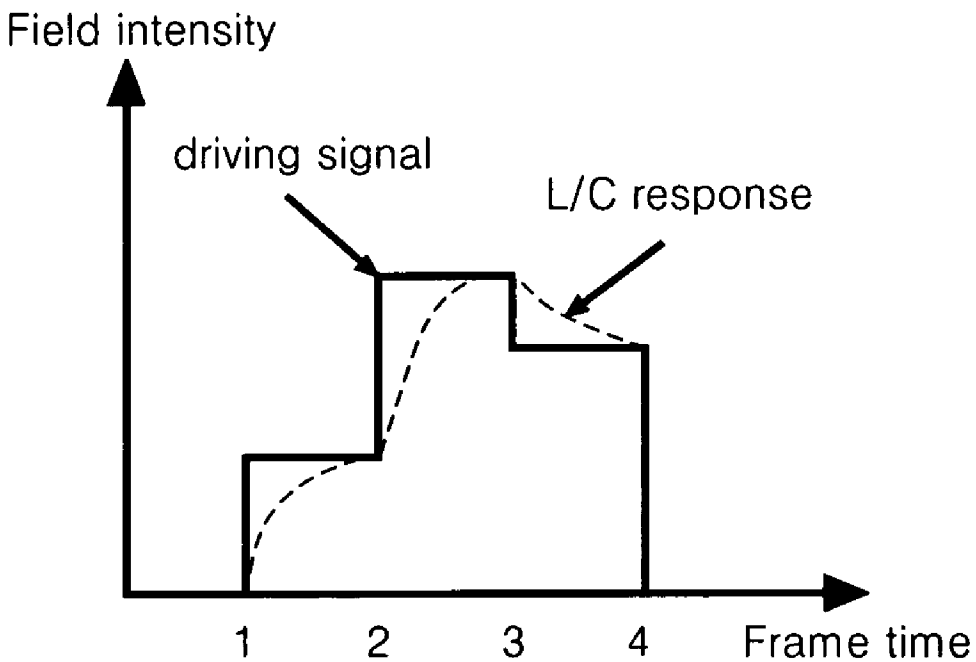
FIG.6 RELATED ART
FIG. 6 is a graph illustrating a characteristic of a hold type display according to the related art.
Figure 7:
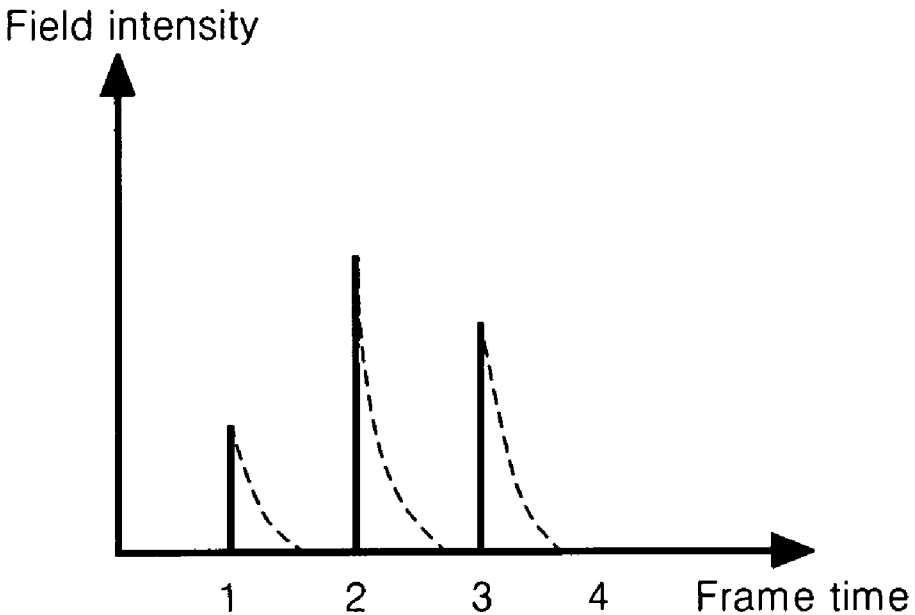
FIG. 7 RELATED ART
FIG. 7 is a graph illustrating a characteristic of impulse type display according to the related art.
Figure 8:
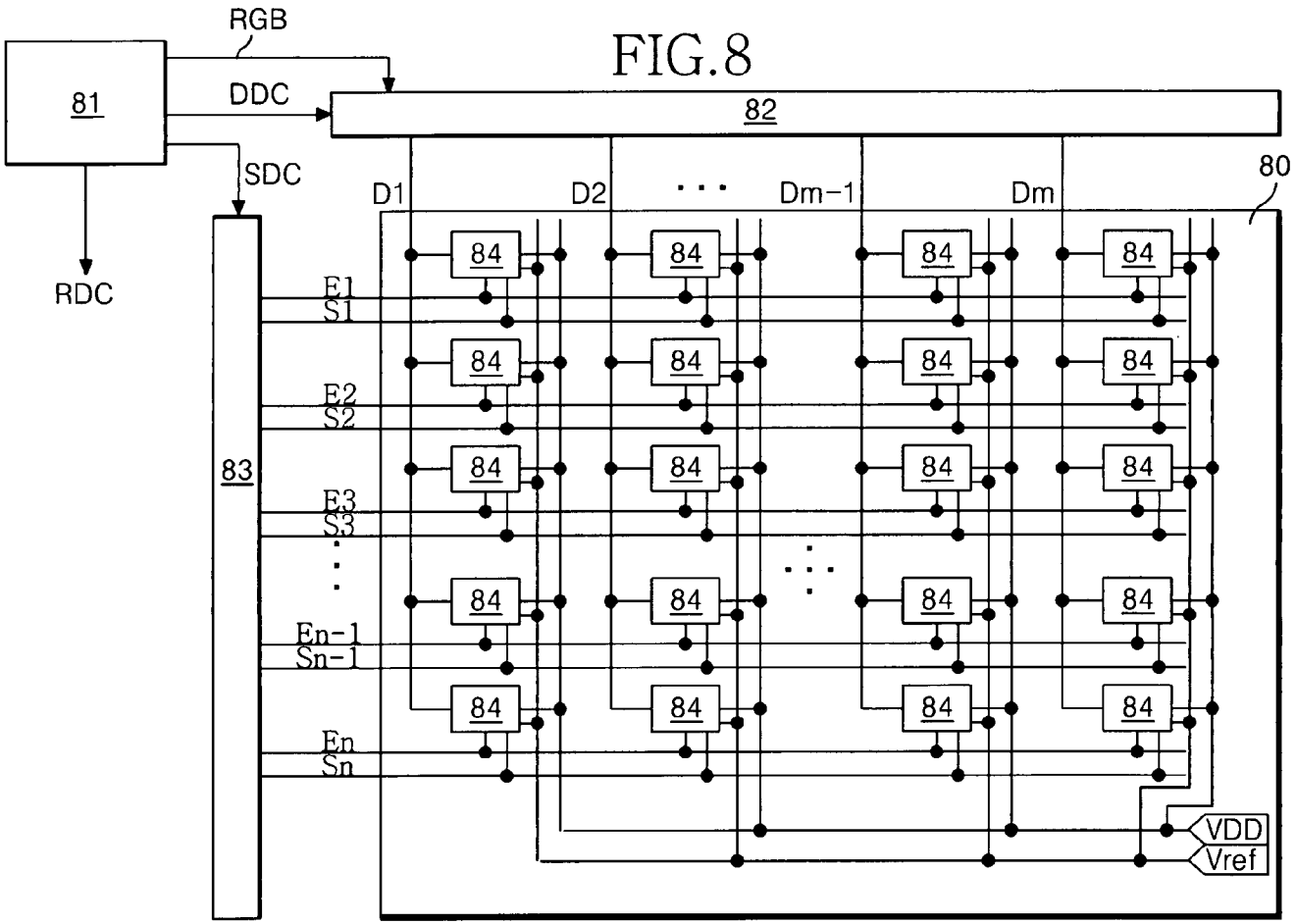
FIG. 8 is a block diagram illustrating an organic light-emitting diode display device according to an embodiment of the invention.

FIG. 8 is a block diagram illustrating an organic light-emitting diode display device according to an embodiment of the invention. In FIG. 8, an organic light-emitting diode display device includes a display panel 80, a data driving device 82, a scan driving device 83, and a timing controller 81. The display panel 80 has m data lines DL1 to DLm, n first scan lines S1 to Sn, n second scan lines E1 to En, and m×n pixels 84. The data driving device 82 supplies a data voltage to the data lines DL1 to DLm. The scan driving device 83 sequentially supplies a first scanning pulse to the first scan lines S1 to Sn, and sequentially supplies a second scanning pulse to the second scan lines E1 to En. The timing controller 81 controls the data driving device 82 and the scan driving device 83.

In addition, the pixels 84 are formed at pixel areas, defined by an intersection of the first and second scan lines (S1 to Sn and E1 to En), and the data lines D1 to Dm. Signal lines are formed at the display panel 80, and the signal lines are connected to a reference voltage source Vref, a high-level driving voltage source VDD, and a ground voltage GND and to each of the pixels 84.

The data driving device 82 converts digital video data RGB from the timing controller 81 into an analog gamma compensation voltage. The data driving device 82 also supplies a data voltage to the data lines DL1 to DLm in response to a data control signal DDC from the timing controller 81. The data voltage may be an analog gamma compensation voltage, and the data voltage is synchronized with the first scanning pulse to be supplied to the data lines DL1 to DLm.

The scan driving device 83 sequentially supplies the first scanning pulse in response to a scan control signal SDC from the timing controller 81 to the first scan lines S1 to Sn, and sequentially supplies a second scanning pulse delayed from the first scanning pulse to the second scan lines E1 to En. The first scanning pulse indicates a time that needs to charge a data into the pixels of a selected line. The second scanning pulse restores a characteristic of a driving TFT and indicates an inserting time of a black data. The pixels of the selected line include the driving TFT.

The timing controller 81 generates the control signals DDC and SDC. The timing controller 81 also supplies digital video data RGB to the data driving device 82 and controls an operating time of the scan driving device 83 and the data driving device 82 in accordance with a vertical/horizontal synchronizing signal and a clock signal. Each of the pixels 84 includes the organic light-emitting diode element OLED, three TFTs, and one storage capacitor. Each of the pixels 84 may have a configuration as shown in one of FIG. 9, FIG. 12, FIG. 13, and FIG. 15 to FIG. 19.

Figure 9:
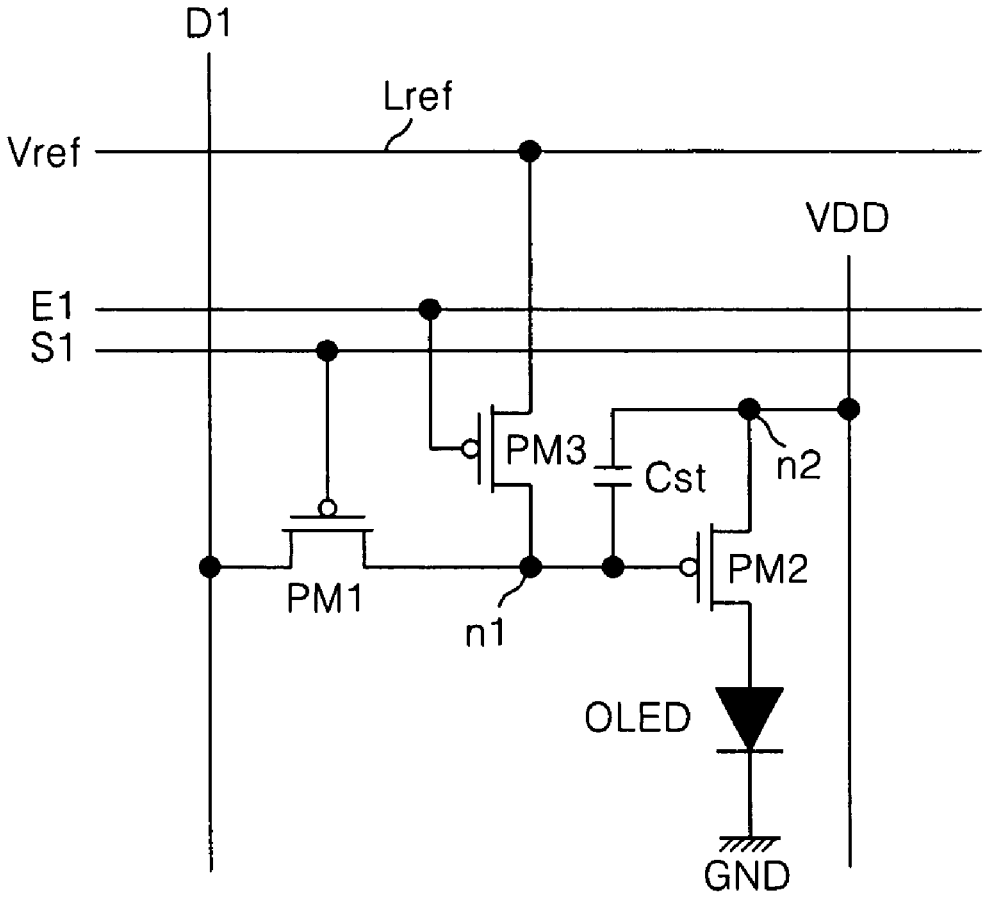
FIG. 9 is a schematic diagram illustrating a pixel of the organic light-emitting diode display device shown in FIG. 8 according to an embodiment of the invention.
Figure 10:
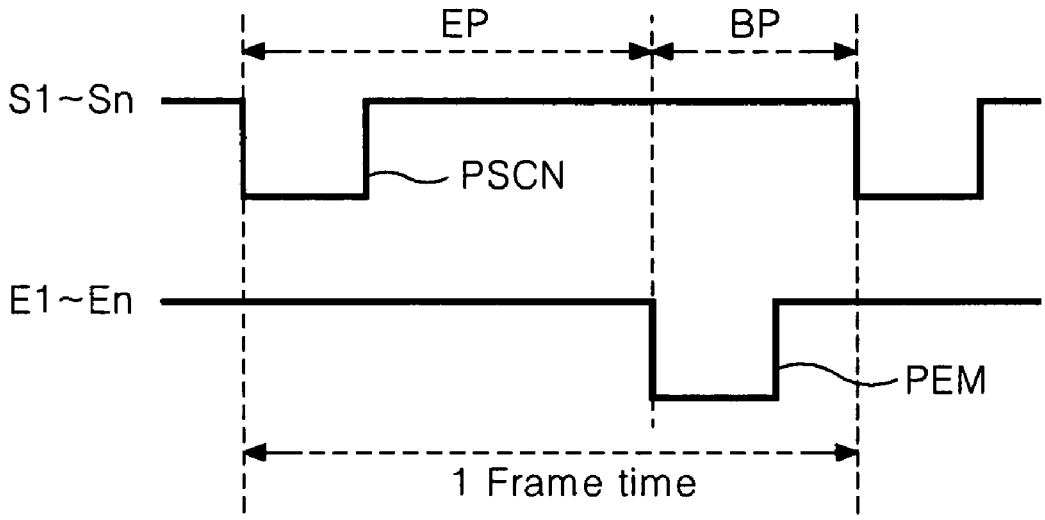
FIG. 10 is a waveform diagram illustrating an exemplary driving waveform for the pixel shown in FIG. 9.
Figure 11:
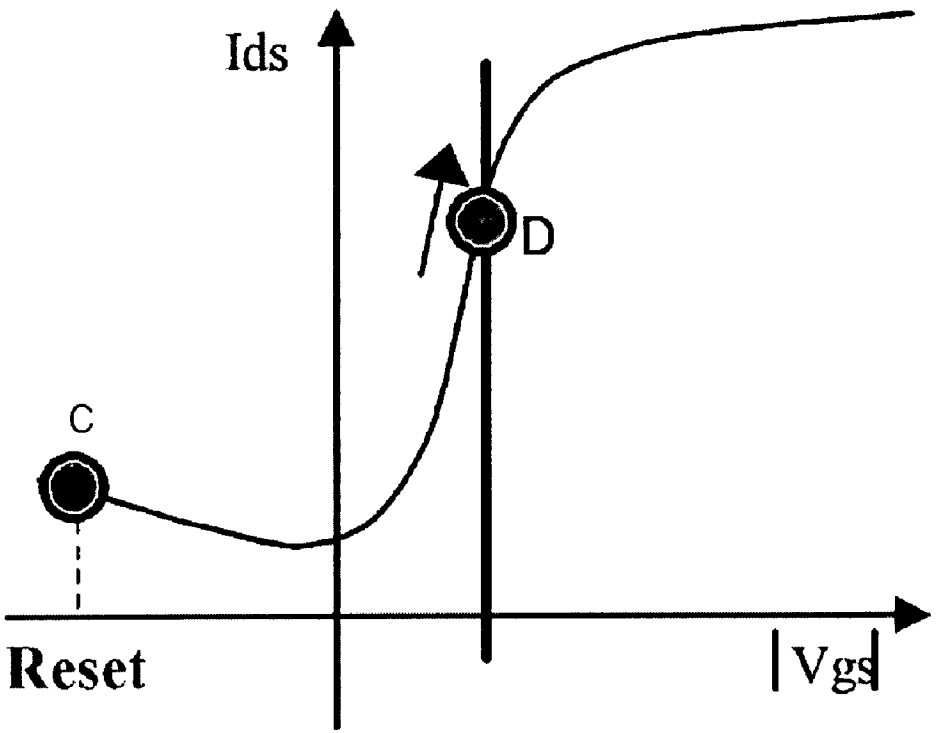
FIG. 11 is a graph illustrating an operation of the driving thin film transistor shown in FIG. 9.

FIG. 9 is a schematic diagram illustrating a pixel of the organic light-emitting diode display device shown in FIG. 8 according to an embodiment of the invention, FIG. 10 is a waveform diagram illustrating an exemplary driving waveform for the pixel shown in FIG. 9, and FIG. 11 is a graph illustrating an operation of the driving thin film transistor shown in FIG. 9. Referring to FIG. 9 and FIG. 10, a pixel includes an organic light-emitting diode element OLED, a storage capacitor Cst, a first TFT PM1, a second TFT PM2, and a third TFT PM3. The storage capacitor Cst is provided between a first node n1 and a second node n2.

The first TFT PM1 forms a current path between a corresponding one of the data lines D1 to Dm and the first node n1 in response to a first scanning signal PSCN. The second TFT PM2 adjusts a current of the organic light-emitting diode element OLED in accordance with a voltage at the first node n1. The third TFT PM3 forms a current path between a reference voltage supply line Lref and the first node n1 in response to a second scanning pulse PEM. The first to the third TFTs PM1 to PM3 are P-type MOS-FETs and may have an amorphous silicon semiconductor layer or a poly silicon semiconductor layer.

In the organic light-emitting diode element OLED, an anode electrode is connected to a drain electrode of the second TFT PM2, a cathode electrode is connected to a ground voltage source GND. A current flowing into the organic light-emitting diode element OLED is constantly maintained by a voltage between a gate electrode and a source electrode of the second TFT PM2. In addition, the storage capacitor Cst is connected between the first and second nodes n1 and n2. The storage capacitor Cst charges a voltage between the gate electrode and the source electrode of the second TFT PM2 for a light emitting period EP of a frame period to maintain a light-emitting amount of the organic light-emitting diode element OLED.

The first TFT PM1 is turned-on in response to the first scanning pulse PSCN from a corresponding one of the first scan lines S1 to Sn at an initial scanning time of the light emitting period EP. Thus, the first TFT PM1 forms a current path between the corresponding one of the data lines D1 to Dm and the first node n1 to supply a data voltage to the first node n1. A gate electrode of the first TFT PM1 is connected to the corresponding one of first scan lines S1 to Sn, and a source electrode of the first TFT PM1 is connected to the corresponding one of the data lines D1 to Dm. Further, a drain electrode of the first TFT PM1 is connected to the first node n1.

The second TFT PM2 is a driving TFT, and allows a current to flow into the organic light-emitting diode element OLED in accordance with a data voltage. Herein, the data voltage is supplied to the first node n1 during the light emitting period EP. For example, the second TFT PM2 is turned-off by a reference voltage Vref to cut off a current path between a high-level driving voltage source VDD and the organic light-emitting diode element OLED. The reference voltage Vref is supplied to the first node n1 during a black data inserting period BP of the frame period. The gate electrode of the second TFT PM2 is connected to the first node n1, and the source electrode of the second TFT PM2 is connected to the high-level driving voltage source VDD. In addition, a drain electrode of the second TFT PM2 is connected to the anode electrode of an organic light-emitting diode element OLED.

The third TFT PM3 supplies a reference voltage Vref to the first node n1 in response to a second scanning pulse PEM from a corresponding one of the second scan lines E1 to En during the black data inserting period BP. A gate electrode of the third TFT PM3 is connected to the corresponding one of the second scan lines E1 to En, and a source electrode of the third TFT PM3 is connected to a reference voltage supply line Lref. In addition, a drain electrode of the third TFT PM3 is connected to the first node n1.

A pixel having the above-described configuration reduces a residual image phenomenon and a motion blurring phenomenon. In general, the residual image phenomenon is generated by the driving TFT having a hysteresis, and the motion blurring phenomenon is generated at a motion picture. However, in a pixel having the above-described configuration, for an initial scanning time of the light emitting period EP, the first scanning pulse PSCN is generated by a low-level scanning voltage to drop a potential of the corresponding one of the first scan lines S1 to Sn to a low-level scanning voltage, and a data voltage is supplied to the corresponding one of the data lines D1 to Dm by the data driving device 82 (shown in FIG. 8). Accordingly, the first TFT PM1 is turned-on by the low-level scanning voltage during the light emitting period EP to supply an analog data voltage corresponding to a video data to the first node n1.

Simultaneously, the storage capacitor Cst stores a difference voltage between a high-level driving voltage source VDD and the first node n1, that is, a voltage between the gate electrode and the source electrode of the second TFT PM2. The second TFT PM2 is turned-on by a data voltage to form a current path between the source electrode and the drain electrode. Thus, it becomes possible to flow a current into the organic light-emitting diode element OLED. Herein, the data voltage is applied via the first node n1.

During the black data inserting period BP, the first scanning pulse PSCN is maintained as a high-level non-scanned voltage, and the second scanning pulse PEM is generated by a low-level scanning voltage to drop a potential of the corresponding one of the second scan lines E1 to En to a low-level scanning voltage. During the black data inserting period BP, the first TFT PM1 is maintained an off-state, and the third TFT PM3 is turned-on by a low-level scanning voltage of the corresponding one of the second scan lines E1 to En to supply a reference voltage Vref to the first node n1. The reference voltage Vref corresponds to a black data, that is, a voltage that is capable of turning-off the second TFT PM2 in order not to flow a current into the organic light-emitting diode element OLED. For example, a reference voltage Vref may be a reset voltage and may be generated by a highest-level analog gamma voltage corresponding to a black data. In this case, the reset voltage initializes a gate voltage of the second TFT PM2.

Thus, according to an embodiment of the invention, a reference voltage Vref is applied to a gate electrode of a driving TFT of a pixel during a black data inserting period BP of each frame period as a reset voltage to initialize an operating point of the driving TFT to "C" point as shown in FIG. 11. A data voltage is then applied at the next frame. Accordingly, an operating point of the driving TFT of a pixel moves from "C" point forward "D" point without an effect of a prior data voltage. As a result, a hysteresis characteristic is not generated. Also, according to an embodiment of the invention, a current of an organic light-emitting diode element OLED is cut off during the black data inserting period BP of a frame period to operate an organic light-emitting diode element OLED as an impulse type display. Thus, it becomes possible to prevent a motion blurring phenomenon.

Figure 12:
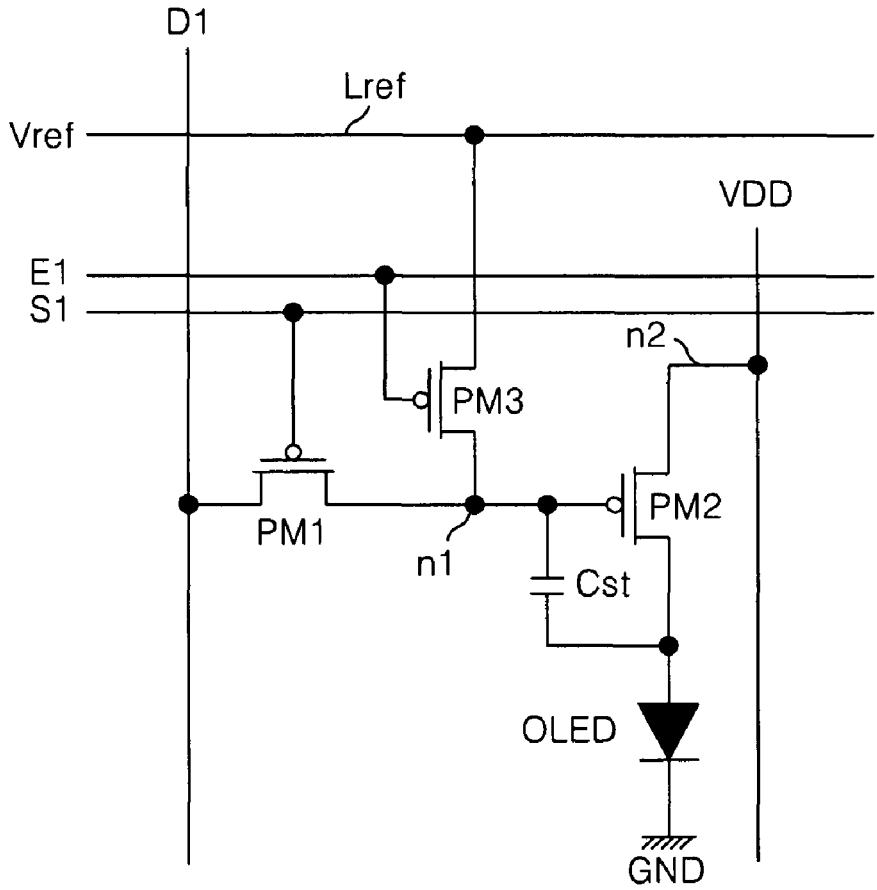
FIG. 12 is a schematic diagram illustrating a pixel of the organic light-emitting diode display device shown in FIG. 8 according to another embodiment of the invention.

FIG. 12 is a schematic diagram illustrating a pixel of the organic light-emitting diode display device shown in FIG. 8 according to another embodiment of the invention. As shown in FIG. 12, a pixel according to an embodiment of the invention alternatively may have a configuration having a storage capacitor Cst connected between a first node n1 and an anode electrode of an organic light-emitting diode element OLED, and the pixel may be driven by the driving waveform shown in FIG. 10.

Figure 13:
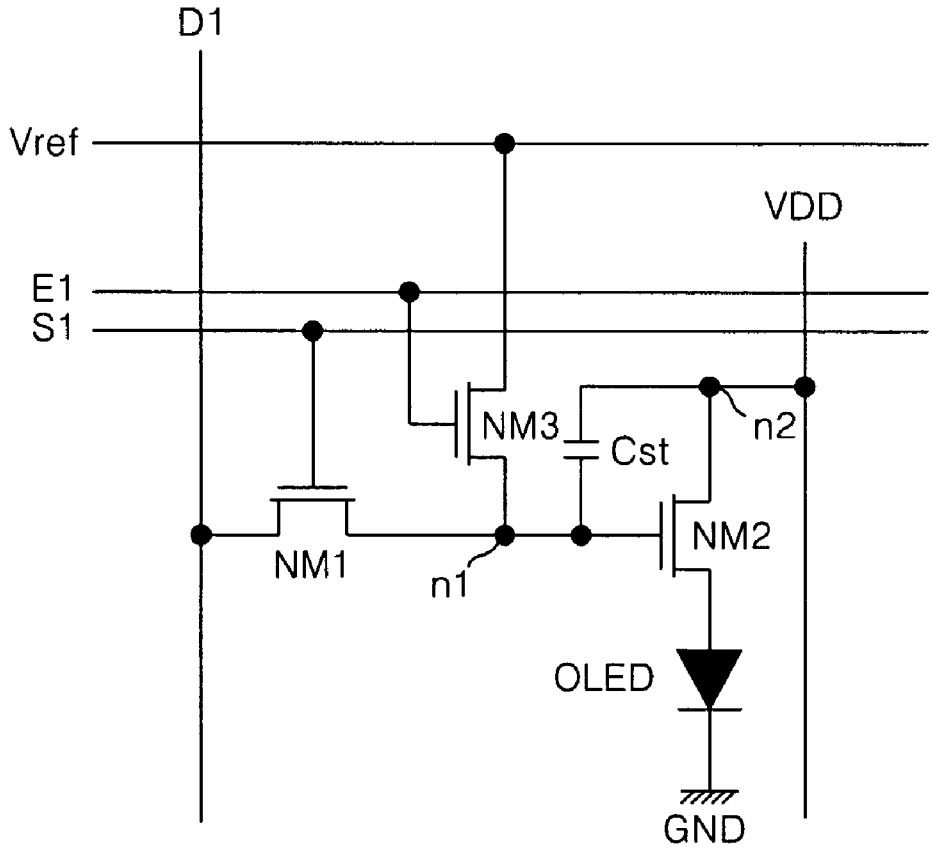
FIG. 13 is a schematic diagram illustrating a pixel of the organic light-emitting diode display device shown in FIG. 8 according to another embodiment of the invention.
Figure 14:
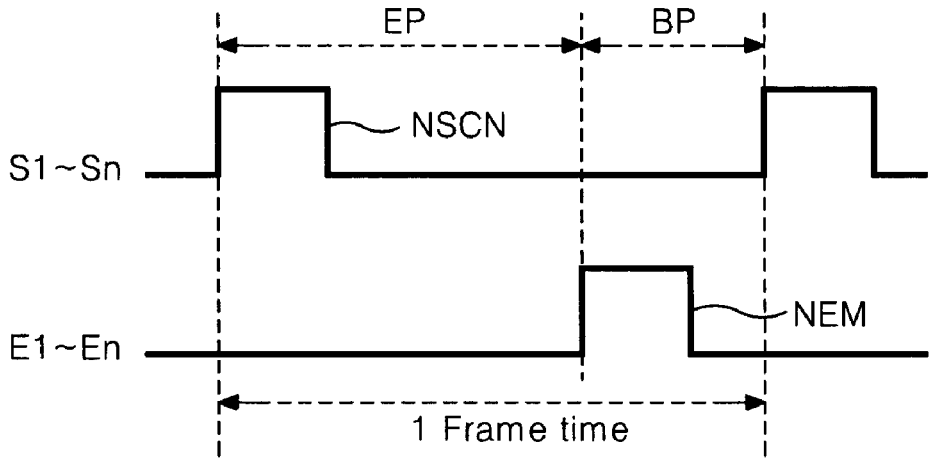
FIG. 14 is a waveform diagram illustrating an exemplary driving waveform for the pixel shown in FIG. 13.

FIG. 13 is a schematic diagram illustrating a pixel of the organic light-emitting diode display device shown in FIG. 8 according to another embodiment of the invention, and FIG. 14 is a waveform diagram illustrating an exemplary driving waveform for the pixel shown in FIG. 13. Referring to FIGS. 13 and 14, a pixel include an organic light-emitting diode element OLED, a storage capacitor Cst, a first TFT NM1, a second TFT NM2, and a third TFT NM3. The storage capacitor Cst is between a first node n1 and a second node n2. The first TFT NM1 forms a current path between a corresponding one of data lines D1 to Dm and the first node n1 in response to a first scanning signal NSCN. The second TFT NM2 adjusts a current of the organic light-emitting diode element OLED in accordance with a voltage at the first node nil. The third TFT NM3 forms a current path between a reference voltage supply line Lref and the first node n1 in response to a second scanning pulse NEM. The first to the third TFTs NM1 to NM3 are N-type MOS-FETs and may have an amorphous silicon semiconductor layer or a poly silicon semiconductor layer.

In the organic light-emitting diode element OLED, an anode electrode is connected to a source electrode of the second TFT NM2, and a cathode electrode is connected to a ground voltage source GND. A current flowing into the organic light-emitting diode element OLED is constantly maintained by a voltage between a gate electrode and a source electrode of the second TFT NM2. In addition, the storage capacitor Cst is connected between the first and second nodes n1 and n2. The storage capacitor Cst charges a voltage between a gate electrode and a source electrode of the second TFT NM2 during a light emitting period EP of a frame period to maintain a light-emitting amount of the organic light-emitting diode element OLED.

The first TFT NM1 is turned-on in response to the first scanning pulse NSCN from the corresponding one of the first scan lines S1 to Sn at an initial scanning time of the light emitting period EP. Thus, the first TFT NM1 forms a current path between the corresponding one of the data lines D1 to Dm and the first node n1 to supply a data voltage to the first node n1. A gate electrode of the first TFT NM1 is connected to the corresponding one of the first scan lines S1 to Sn, and a drain electrode of the first TFT NM1 is connected to the corresponding one of the data lines D1 to Dm. In addition, a source electrode of the first TFT NM1 is connected to the first node n1.

The second TFT NM2 is a driving TFT, and allows a current to flow into the organic light-emitting diode element OLED in accordance with a data voltage. Herein, the data voltage is supplied to the first node n1 during the light emitting period EP. For example, the second TFT NM2 is turned-off by a reference voltage Vref to cut off a current path between a high-level driving voltage VDD and the organic light-emitting diode element OLED. The reference voltage Vref is supplied to the first node n1 during a black data inserting period BP of the frame period. A gate electrode of the second TFT NM2 is connected to the first node n1, and a drain electrode of the second TFT NM2 is connected to the high-level driving voltage source VDD. In addition, a source electrode of the second TFT NM2 is connected to an anode electrode of the organic light-emitting diode element OLED.

The third TFT NM3 supplies a reference voltage Vref to the first node n1 in response to a second scanning pulse NEM from a corresponding one of the second scan lines E1 to En for a black data inserting period BP. A gate electrode of the third TFT NM3 is connected to the corresponding one of the second scan lines E1 to En, and a drain electrode of the third TFT NM3 is connected to a reference voltage supply line Lref. In addition, a source electrode of the third TFT NM3 is connected to the first node n1.

A gate voltage of a second TFT NM2 is initialized during the black data inserting period BP. Thus, the pixel 84 can prevent a hysteresis phenomenon of a driving TFT. In addition, the pixel 84 can improve a motion blurring phenomenon generated at a motion picture because of a black data inserting effect.

During an initial scanning time of the light emitting period EP, the first scanning pulse NSCN is generated by a high-level scanning voltage to boost a potential of a selected one of first scan lines S1 to Sn to a high-level scanning voltage, and a data voltage is supplied to the corresponding one of data lines D1 to Dm by the data driving device 82 (shown in FIG. 8). Accordingly, the first TFT NM1 is turned-on by a high-level scanning voltage during the light emitting period EP of the frame period to supply an analog data voltage corresponding to a video data to the first node n1. Simultaneously, the storage capacitor Cst stores a difference voltage between the high-level driving voltage source VDD and the first node n1, and the second TFT NM2 is turned-on by a data voltage to form a current path between a drain electrode and a source electrode. Herein, a data voltage is applied via the first node n1. Thus, it becomes possible to flow a current into the organic light-emitting diode element OLED.

During the black data inserting period BP, the first scanning pulse NSCN is maintained a low-level non-scanned voltage, and the second scanning pulse NEM is generated by a high-level scanning voltage to boost a potential of the corresponding one of the second scan lines E1 to En to a high-level scanning voltage. During the black data inserting period BP, the first TFT NM1 is maintained an off-state, and the third TFT NM3 is turned-on by a high-level scanning voltage of the corresponding one of the second scan lines E1 to En to supply a reference voltage Vref to the first node n1. Herein, the reference voltage Vref is a voltage corresponding to a black data, that is, a voltage that is capable of turning-off the second TFT NM2 in order not to flow a current into the organic light-emitting diode element OLED. For example, the reference voltage Vref may be a reset voltage, and is generated by a lowest-level analog gamma voltage corresponding to a black data. Herein, the reset voltage initializes a gate voltage of the second TFT NM2.

Figure 15:
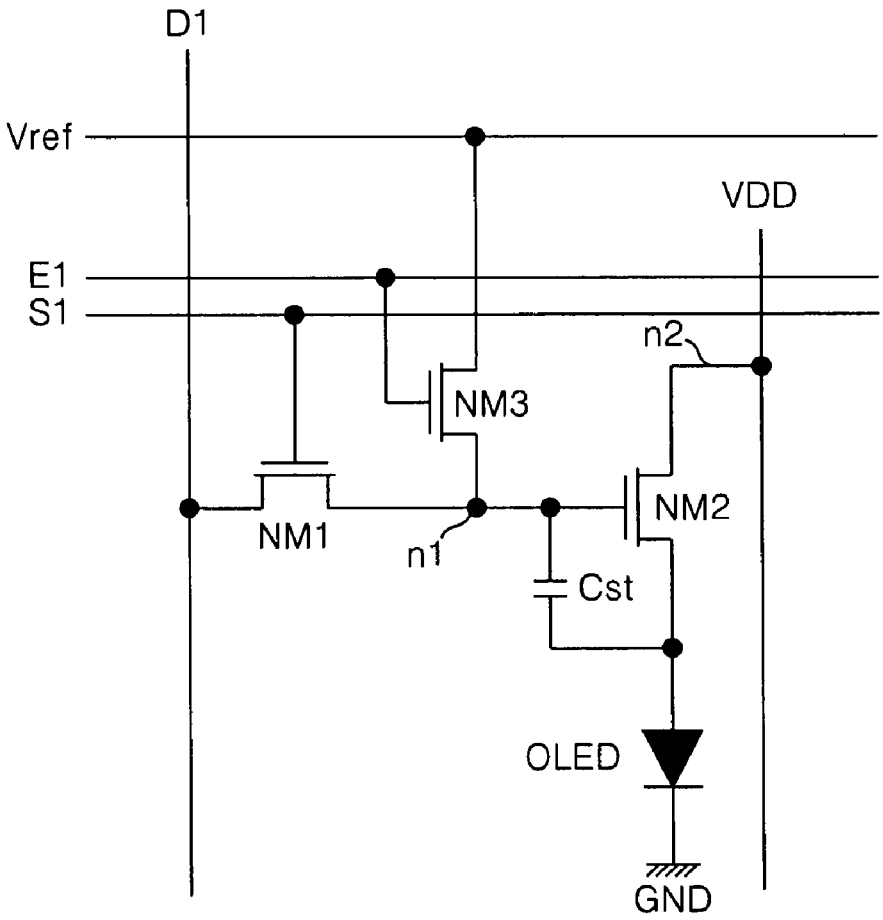
FIGS. 15 to 19 are schematic diagrams illustrating a pixel of the organic light-emitting diode display device shown in FIG. 8 according to embodiments of the invention, respectively.

FIGS. 15 to 19 are schematic diagrams illustrating a pixel of the organic light-emitting diode display device shown in FIG. 8 according to embodiments of the invention, respectively. As shown in FIG. 15, a pixel according to an embodiment of the invention alternatively may have a configuration having a storage capacitor Cst connected between a first node n1 and an anode electrode of an organic light-emitting diode element OLED, and the pixel may be driven by the driving waveform shown in FIG. 14.

Figure 16:
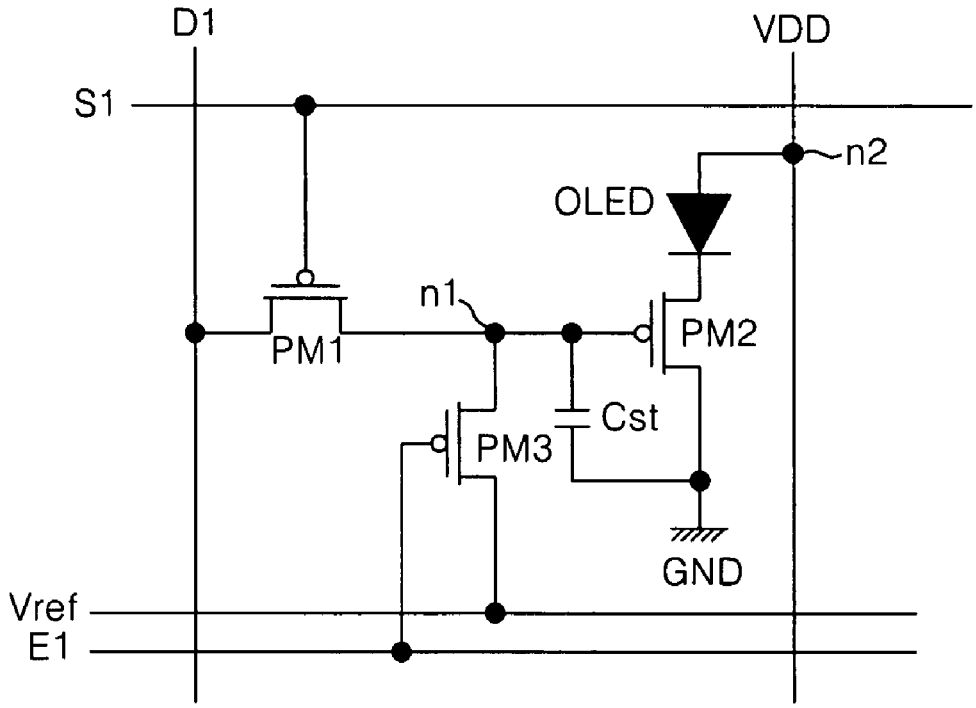

Alternatively, as shown in FIG. 16, a pixel according to an embodiment of the invention includes an organic light-emitting diode element OLED, a storage capacitor Cst, and a second TFT PM2. An anode electrode of the organic light-emitting diode element OLED is connected, via a second node n2, to a high-level driving voltage source VDD, and a cathode electrode of the organic light-emitting diode element OLED is connected to a source electrode of the second TFT PM2. The storage capacitor Cst is connected between a first node n1 and a ground voltage source GND. In addition, the gate electrode of the second TFT PM2 is connected to the first node n1. The source electrode of the second TFT PM2 is connected to the cathode electrode of the organic light-emitting diode element OLED, and the drain electrode of the second TFT PM2 is connected to the ground voltage source GND. The pixel may be driven by the driving waveform shown in FIG. 10.

Figure 17:
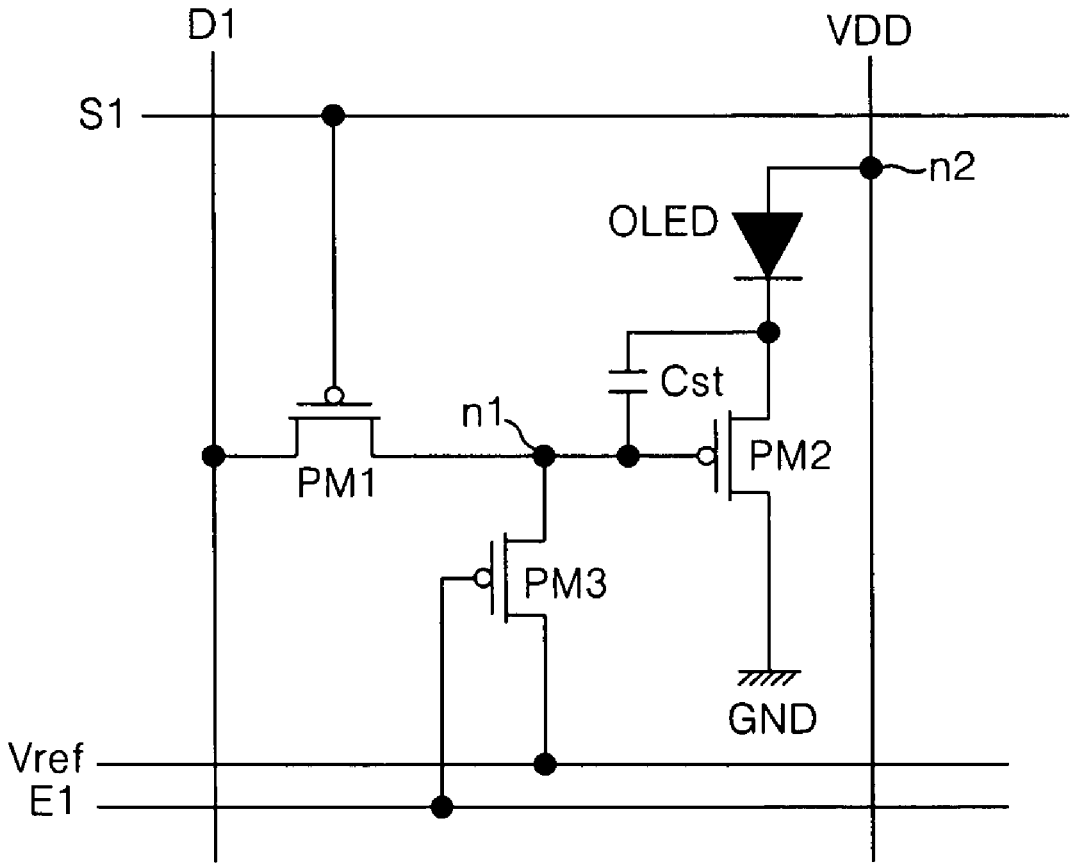

As shown in FIG. 17, a pixel according to an embodiment of the invention alternatively may have a configuration having a storage capacitor Cst connected between a first node n1 and a cathode electrode of an organic light-emitting diode element OLED. That is, the storage capacitor is connected between a gate electrode and a source electrode of a second TFT PM2, and the pixel may be driven by the driving waveform shown in FIG. 10.

Figure 18:
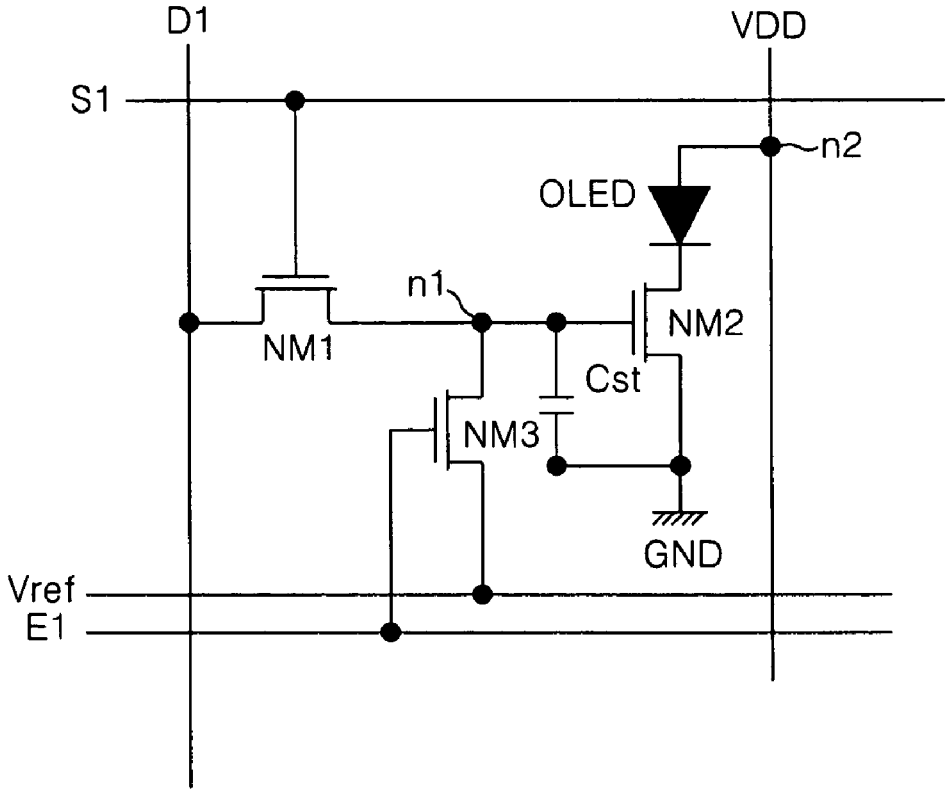

Alternatively, as shown in FIG. 18, a pixel according to an embodiment of the invention includes an organic light-emitting diode element OLED, a storage capacitor Cst, and a second TFT NM2. An anode electrode of the organic light-emitting diode element OLED is connected to a high-level driving voltage source VDD, and a cathode electrode of the organic light-emitting diode element OLED is connected to a drain electrode of the second TFT NM2. the storage capacitor Cst is connected between a first node n1 and a ground voltage source GND. In addition, the gate electrode of the second TFT NM2 is connected to the first node n1. The drain electrode of the second TFT NM2 is connected to the cathode electrode of the organic light-emitting diode element OLED, and the source electrode of the second TFT NM2 is connected to the ground voltage source GND. The pixel may be driven by the driving waveform shown in FIG. 14.

Figure 19:
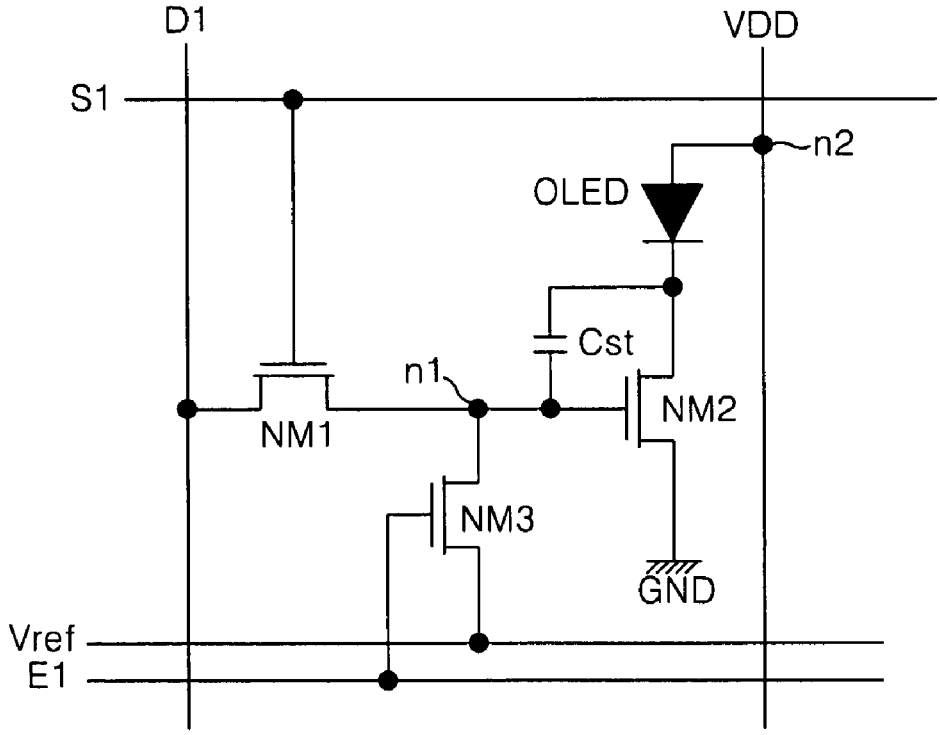

As shown in FIG. 19, a pixel according to an embodiment of the invention alternatively may have a configuration having a storage capacitor Cst connected between a first node n1 and an anode electrode of an organic light-emitting diode element OLED. That is, the storage capacitor is connected between a gate electrode and a source electrode of a second TFT NM2, and the pixel may be driven by the driving waveform shown in FIG. 14.

Figure 20:
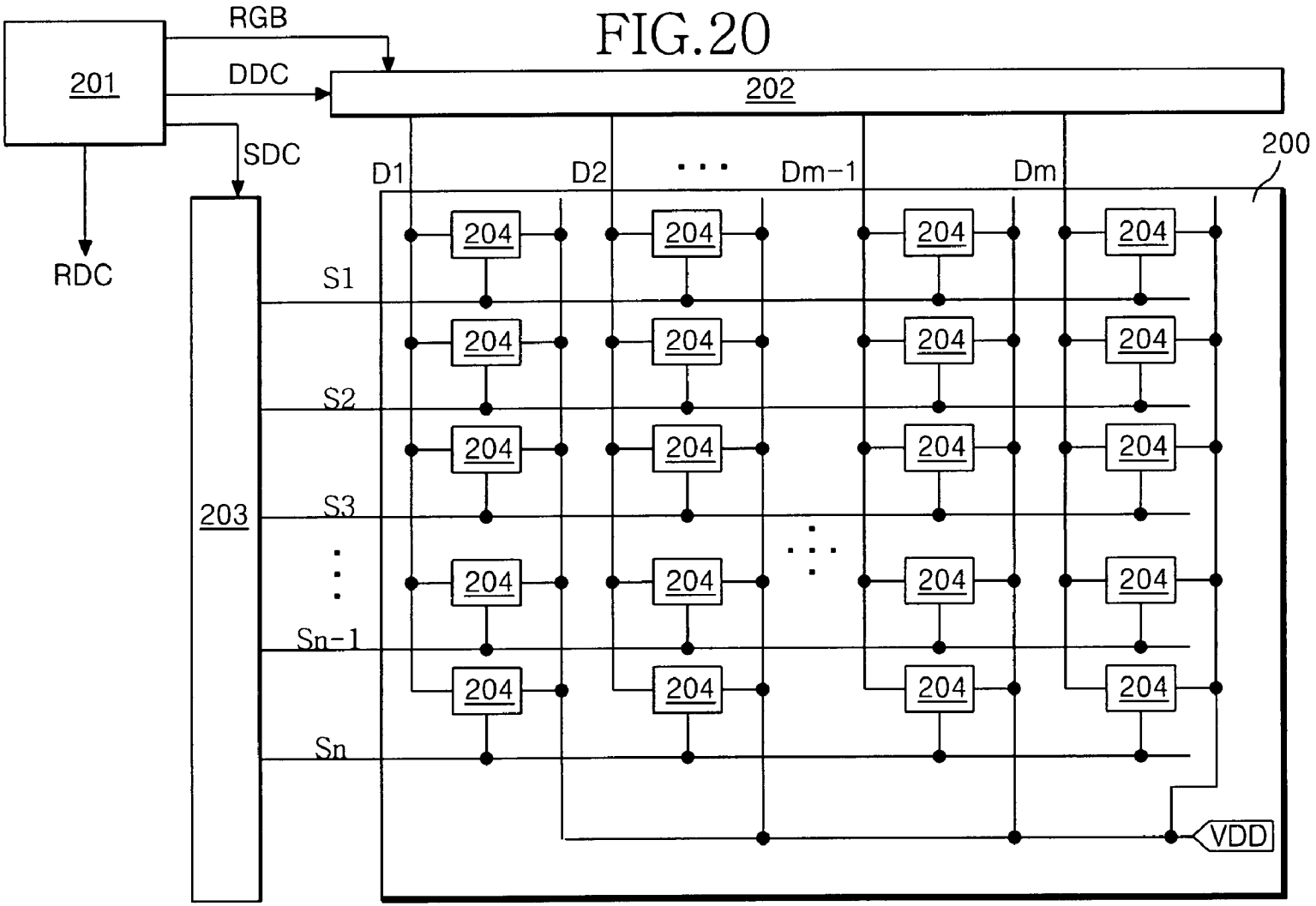
FIG. 20 is a block diagram illustrating an organic light-emitting diode display device according to another embodiment of the invention.

FIG. 20 is a block diagram illustrating an organic light-emitting diode display device according to another embodiment of the invention. In FIG. 20, an organic light-emitting diode display device includes a display panel 200, a data driving device 202, a scan driving device 203, and a timing controller 201. The display panel 200 has m data lines DL1 to DLm, n scan lines S1 to Sn, and m×n pixels 204. The data driving device 202 alternatively supplies a data voltage and a reset voltage to the data lines DL1 to DLm. The scan driving device 203 sequentially supplies a first scanning pulse and a second scanning pulse to the scan lines S1 to Sn. The timing controller 201 controls the data driving device 202 and the scan driving device 203.

In addition, the pixels 204 are formed at pixel areas, defined by an intersection of the scan lines S1 to Sn and the data lines D1 to Dm. Signal lines also are formed at the display panel 200, and the signal lines are connected to a high-level driving voltage source VDD and a ground voltage GND and to each of the pixels 204.

The data driving device 202 converts digital video data RGB from the timing controller 201 into an analog gamma compensation voltage. The data driving device 202 also supplies a data voltage to the data lines DL1 to DLm in response to a data control signal DDC from the timing controller 201. The data voltage may be an analog gamma compensation voltage, and the data voltage is applied in synchronization with the first scanning pulse to be supplied to the data lines DL1 to DLm. The data driving device 202 also supplies a reset voltage to the data lines D1 to Dm. The reset voltage prevents light from being emitting at an organic light-emitting diode element OLED of the pixel 204, and identically restores an operating point of a driving TFT of the pixel 204 for each frame period.

The scan driving device 203 sequentially supplies the first scanning pulse in response to a scan control signal SDC from the timing controller 201 to the scan lines S1 to Sn. The first scanning pulse is applied in synchronization with the data voltage. The scan driving device 203 also sequentially supplies the second scanning pulse delayed from the first scanning pulse to the scan lines S1 to Sn. The second scanning pulse is applied in synchronization the reset voltage. A pulse width of the second scanning pulse may be shorter than that of the first scanning pulse.

The timing controller 201 generates the control signals DDC and SDC. The timing controller 201 also supplies digital video data RGB to the data driving device 202 and controls an operating time of the scan driving device 203 and the data driving device 202 in accordance with a vertical/horizontal synchronizing signal and a clock signal. Each of the pixels 204 includes the organic light-emitting diode element OLED, two TFTs, and one storage capacitor. Each of the pixels 204 may have a configuration as shown in one of FIG. 21, FIG. 23 to FIG. 26 and FIG. 28 to FIG. 30.

Figure 21:
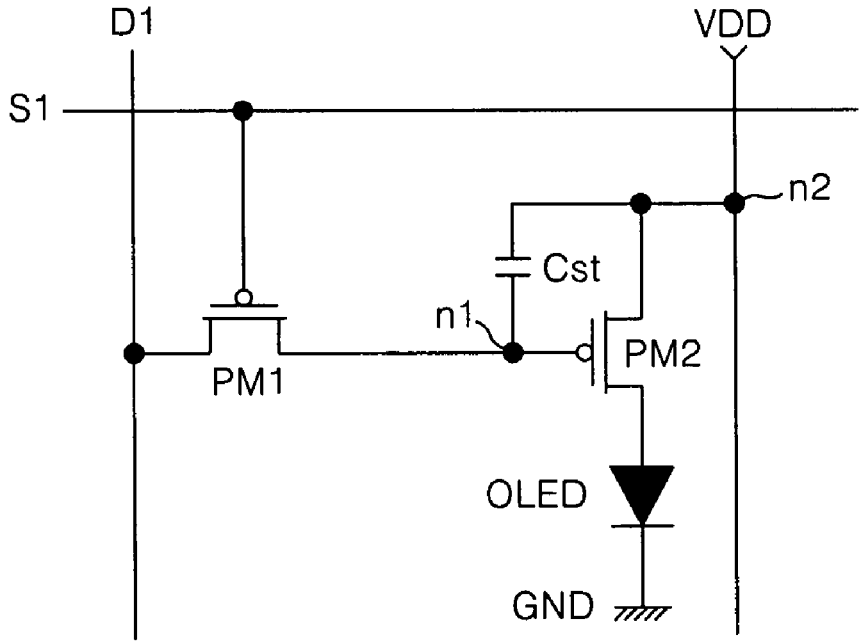
FIG. 21 is a schematic diagram illustrating a pixel of the organic light-emitting diode display device shown in FIG. 20 according to an embodiment of the invention.
Figure 22:
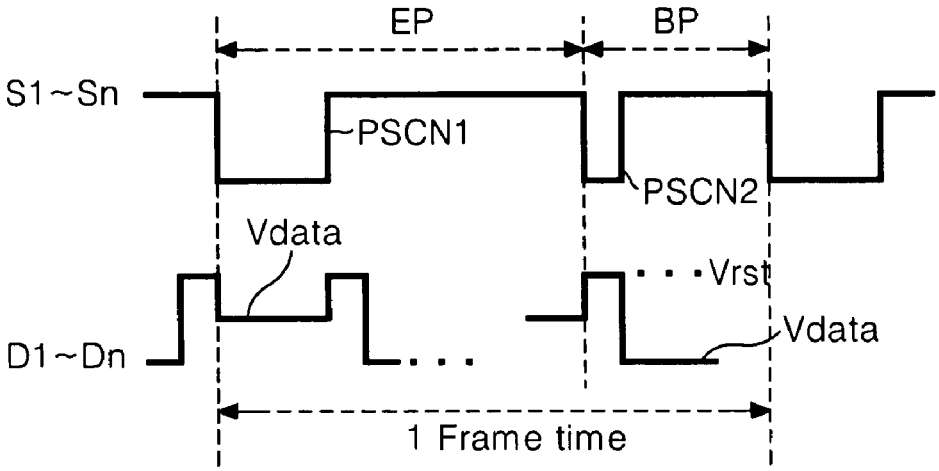
FIG. 22 is a waveform diagram illustrating an exemplary driving waveform for the pixel shown in FIG. 21.

FIG. 21 is a schematic diagram illustrating a pixel of the organic light-emitting diode display device shown in FIG. 20 according to an embodiment of the invention, and FIG. 22 is a waveform diagram illustrating an exemplary driving waveform for the pixel shown in FIG. 21. Referring to FIG. 21 and FIG. 22, a pixel includes an organic light-emitting diode element OLED, a storage capacitor Cst, a first TFT PM1, and a second TFT PM2. The storage capacitor Cst is provided between a first node n1 and a second node n2.

The first TFT PM1 forms a current path between a corresponding one of the data lines D1 to Dm and the first node n1 in response to a first scanning signal PSCN1 and a second scanning signal PSCN2. The second TFT PM2 adjusts a current of the organic light-emitting diode element OLED in accordance with a voltage at the first node n1. The first and second TFTs PM1 and PM2 are P-type MOS-FETs and may have an amorphous silicon semiconductor layer or a poly silicon semiconductor layer.

In the organic light-emitting diode element OLED, an anode electrode is connected to a drain electrode of the second TFT PM2, a cathode electrode is connected to a ground voltage source GND. A current flowing into the organic light-emitting diode element OLED is constantly maintained by a voltage between a gate electrode and a source electrode of the second TFT PM2. In addition, the storage capacitor Cst is connected between the first and second nodes n1 and n2. The storage capacitor Cst charges a voltage between the gate electrode and the source electrode of the second TFT PM2 for a light emitting period EP of a frame period to maintain a light-emitting amount of the organic light-emitting diode element OLED.

The first TFT PM1 is turned-on in response to the first scanning pulse PSCN1 from a corresponding one of the scan lines S1 to Sn at an initial scanning time of the light emitting period EP. Thus, the first TFT PM1 forms a current path between the corresponding one of the data lines D1 to Dm and the first node n1 to supply a data voltage Vdata to the first node n1. The first TFT PM1 also is turned-on in response to the second scanning pulse PSCN2 from the corresponding one of the scan lines S1 to Sn at an initial scanning period of a black data inserting period BP of the frame period. Thus, the first TFT PM1 forms a current path between the corresponding one of the data lines D1 to Dm and the first node n1 to supply a reset voltage Vrst to the first node n1. A gate electrode of the first TFT PM1 is connected to the corresponding one of first scan lines S1 to Sn, and a source electrode of the first TFT PM1 is connected to the corresponding one of the data lines D1 to Dm. Further, a drain electrode of the first TFT PM1 is connected to the first node n1.

The second TFT PM2 is a driving TFT, and allows a current to flow into the organic light-emitting diode element OLED in accordance with a data voltage. Herein, the data voltage is supplied to the first node n1 during the light emitting period EP. For example, the second TFT PM2 is turned-off by a reset voltage Vrst to cut off a current path between a high-level driving voltage source VDD and the organic light-emitting diode element OLED. The reset voltage Vrst is supplied to the first node n1 during the black data inserting period BP. The gate electrode of the second TFT PM2 is connected to the first node n1, and the source electrode of the second TFT PM2 is connected to the high-level driving voltage source VDD. In addition, a drain electrode of the second TFT PM2 is connected to the anode electrode of an organic light-emitting diode element OLED.

The pixel 204 can improve a residual image phenomenon and a motion blurring phenomenon. In a pixel having the above-described configuration, for an initial scanning time of the light emitting period EP, the first scanning pulse PSCN1 is generated by a low-level scanning voltage to drop a potential of the corresponding one of the first scan lines S1 to Sn to a low-level scanning voltage, and the analog data voltage Vdata is supplied to the corresponding one of the data lines D1 to Dm by the data driving device 202 (shown in FIG. 8). Accordingly, the first TFT PM1 is turned-on by the low-level scanning voltage during the light emitting period EP to supply the analog data voltage Vdata corresponding to a video data to the first node n1.

Simultaneously, the storage capacitor Cst stores a difference voltage between a high-level driving voltage source VDD and the first node n1, that is, a voltage between the gate electrode and the source electrode of the second TFT PM2. The second TFT PM2 is turned-on by a data voltage to form a current path between the source electrode and the drain electrode. Thus, it becomes possible to flow a current into the organic light-emitting diode element OLED. Herein, the data voltage is applied via the first node n1.

During an initial scanning period of the black data inserting period BP, the second scanning pulse PSCN2 of a low-level scanning voltage is supplied to the corresponding one of the scan lines S1 to Sn and, at the same time a high-level reset voltage Vrst corresponding to a black data is supplied to the corresponding one of the data lines D1 to Dm. Thus, the first TFT PM1 is turned-on by the second scanning pulse PSCN2 to supply the high-level reset voltage Vrst to the first node n1. In addition, the second TFT PM2 is turned-off and initialized by the high-level reset voltage Vrst. The high-level reset voltage Vrst is applied to the gate electrode of the second TFT PM2. Thus, a current and a light-emitting amount of an organic light-emitting diode element OLED become '0'.

Thus, according to an embodiment of the invention, a reset voltage Vrst is applied to a gate electrode of a driving TFT of a pixel during a black data inserting period BP of each frame period to initialize an operating point of the driving TFT to "C" point as shown in FIG. 11. A data voltage is then applied at the next frame. Accordingly, an operating point of the driving TFT moves from "C" point forward "D" point without an effect of a prior data voltage. As a result, a hysteresis characteristic is not generated. Also, according to an embodiment of the invention, a current of an organic light-emitting diode element OLED is cut off during the black data inserting period BP to operate an organic light-emitting diode element OLED as an impulse type display. Thus, it becomes possible to prevent a motion blurring phenomenon.

Figure 23:
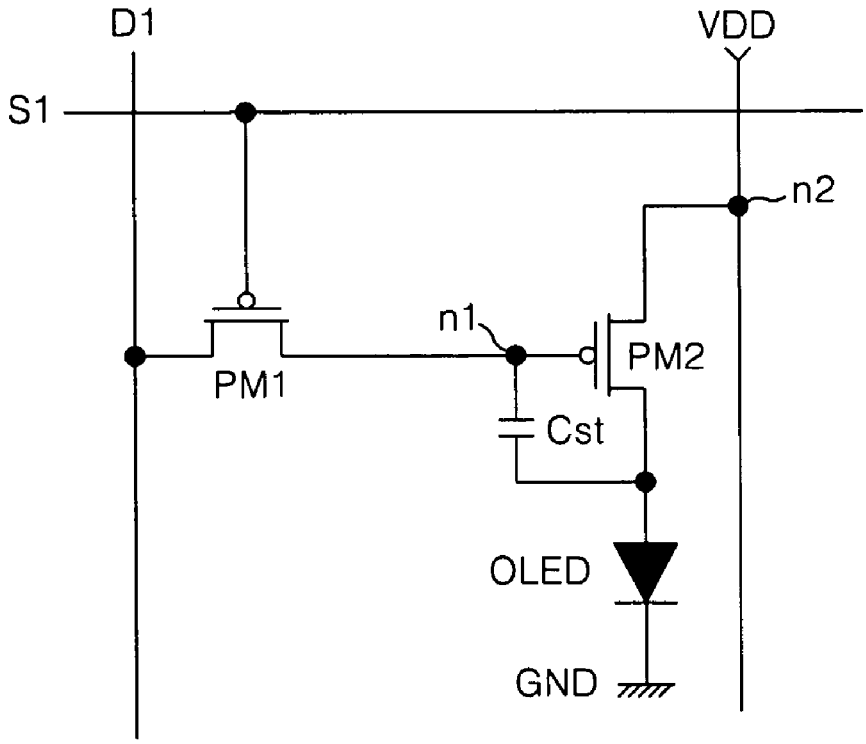
FIGS. 23 to 26 are schematic diagrams illustrating a pixel of the organic light-emitting diode display device shown in FIG. 20 according to embodiments of the invention, respectively.

FIGS. 23 to 26 are schematic diagrams illustrating a pixel of the organic light-emitting diode display device shown in FIG. 20 according to embodiments of the invention, respectively. As shown in FIG. 23, a pixel according to an embodiment of the invention alternatively may have a configuration having a storage capacitor Cst connected between a first node n1 and an anode electrode of an organic light-emitting diode element OLED, and the pixel may be driven by the driving waveform shown in FIG. 22.

Figure 24:
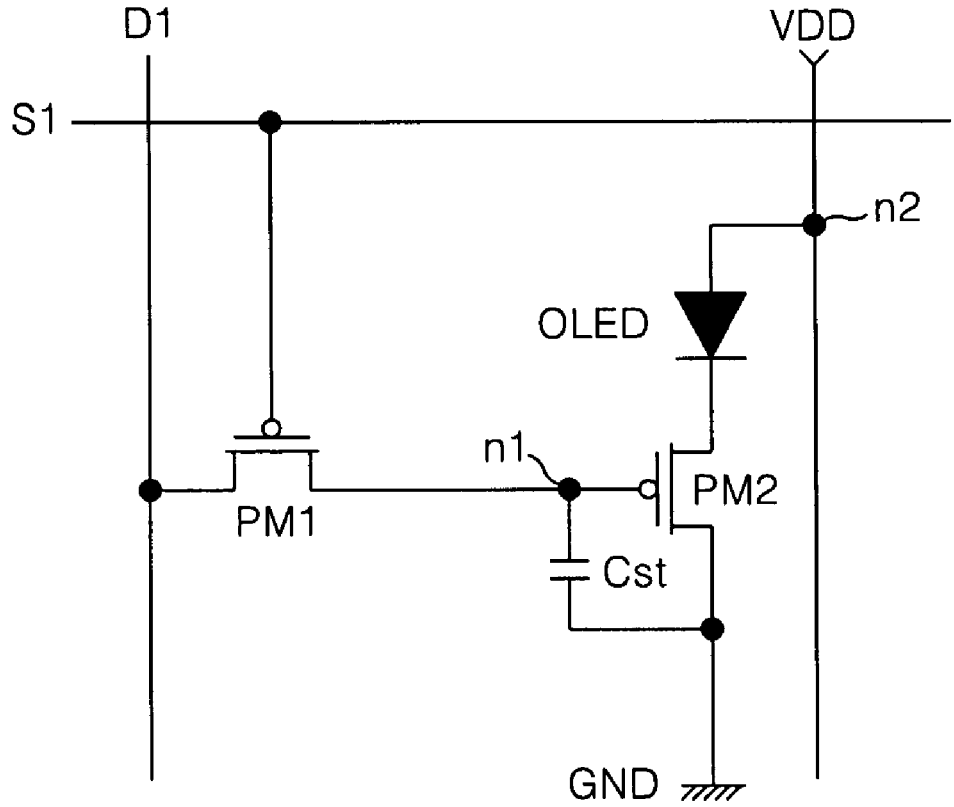

Alternatively, as shown in FIG. 24, a pixel according to an embodiment of the invention includes an organic light-emitting diode element OLED, a storage capacitor Cst, and a second TFT PM2. An anode electrode of the organic light-emitting diode element OLED is connected, via a second node n2, to a high-level driving voltage source VDD, and a cathode electrode of the organic light-emitting diode element OLED is connected to a source electrode of the second TFT PM2. The storage capacitor Cst is connected between a first node n1 and a ground voltage source GND. In addition, the gate electrode of the second TFT PM2 is connected to the first node n1. The source electrode of the second TFT PM2 is connected to the cathode electrode of the organic light-emitting diode element OLED, and the drain electrode of the second TFT PM2 is connected to the ground voltage source GND. The pixel may be driven by the driving waveform shown in FIG. 22.

Figure 25:
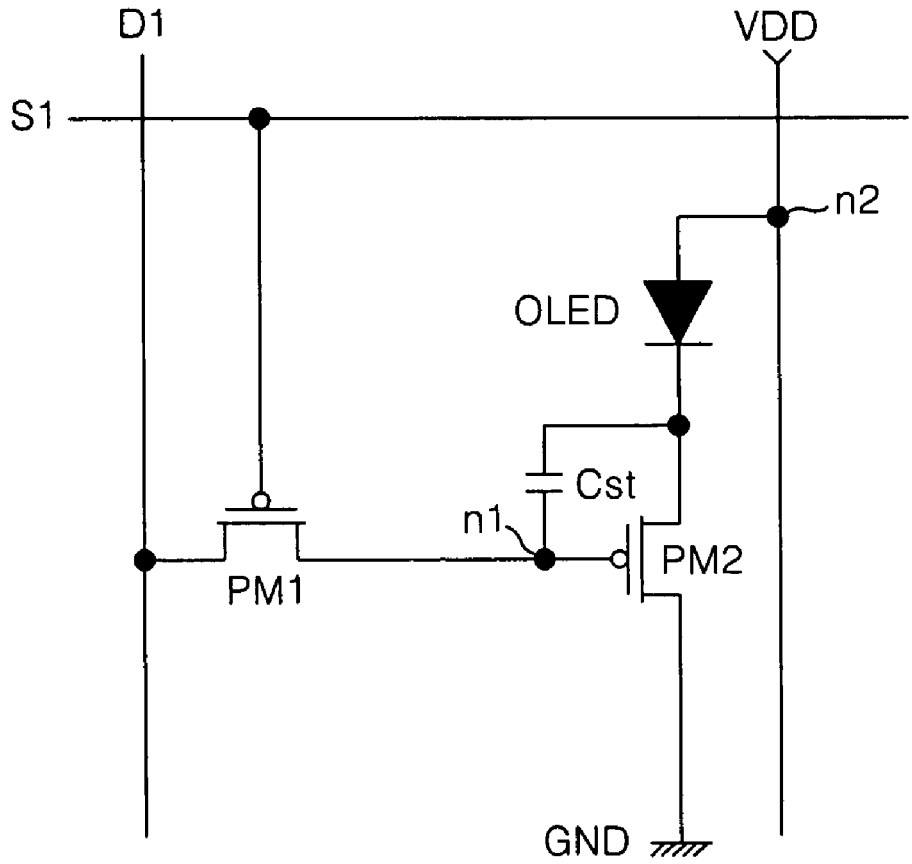

As shown in FIG. 25, a pixel according to an embodiment of the invention alternatively may have a configuration having a storage capacitor Cst connected between a first node n1 and a cathode electrode of an organic light-emitting diode element OLED. That is, the storage capacitor is connected between a gate electrode and a source electrode of a second TFT PM2, and the pixel may be driven by the driving waveform shown in FIG. 22.

Figure 26:
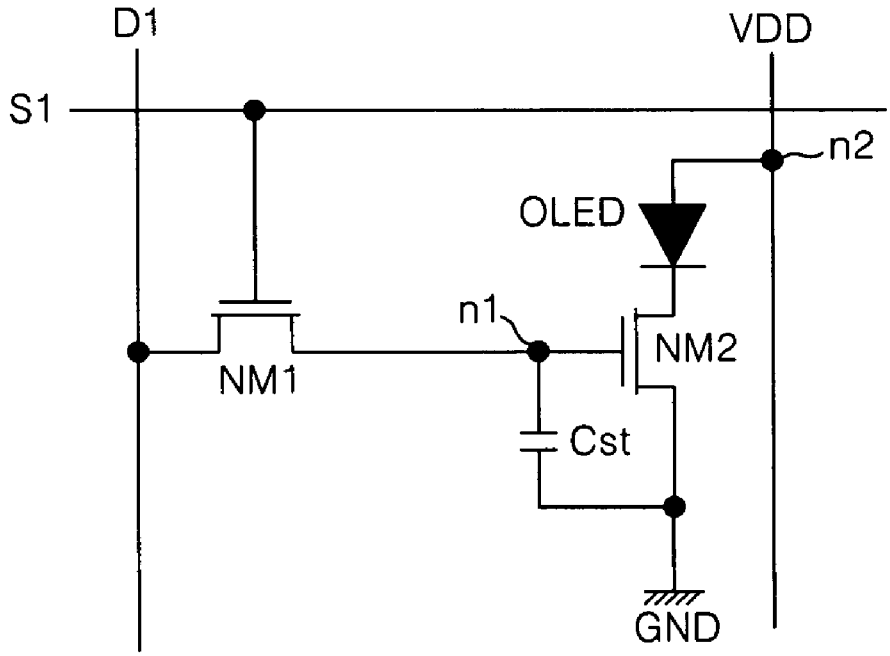
Figure 27:
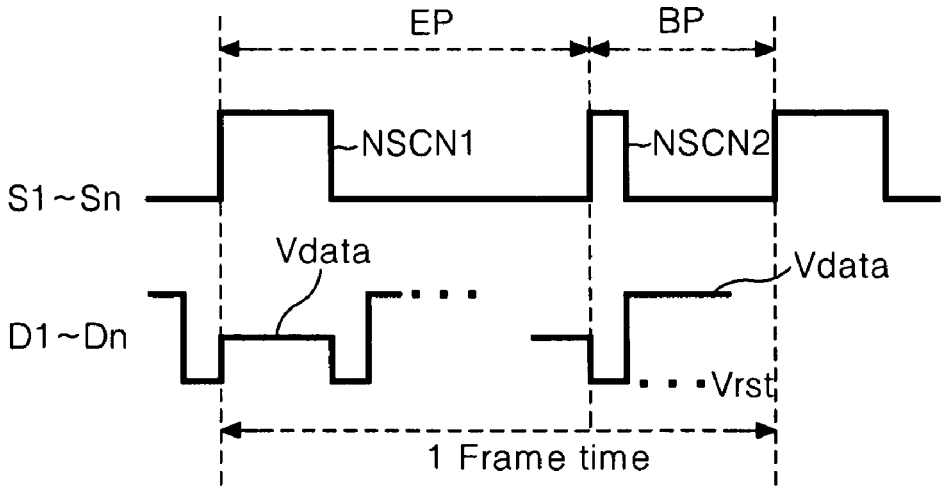
FIG. 27 is a waveform diagram illustrating an exemplary driving waveform for the pixel shown in FIG. 26.

FIG. 26 is a schematic diagram illustrating a pixel of the organic light-emitting diode display device shown in FIG. 20 according to another embodiment of the invention, and FIG. 27 is a waveform diagram illustrating an exemplary driving waveform for the pixel shown in FIG. 26. Referring to FIGS. 26 and 27, a pixel include an organic light-emitting diode element OLED, a storage capacitor Cst, a first TFT NM1, and a second TFT NM2. The storage capacitor Cst is between a first node n1 and a ground voltage source GND. The first TFT NM1 forms a current path between a corresponding one of data lines D1 to Dm and the first node n1 in response to first and second scanning signals NSCN1 and NSCN2. The second TFT NM2 adjusts a current of the organic light-emitting diode element OLED in accordance with a voltage at the first node n1. The first and second TFTs NM1 and NM2 are N-type MOS-FETs and may have an amorphous silicon semiconductor layer or a poly silicon semiconductor layer.

In the organic light-emitting diode element OLED, an anode electrode is connected, via a second node n2, to a high-level driving voltage source VDD, and a cathode electrode is connected to a drain electrode of the second TFT NM2. A current flowing into the organic light-emitting diode element OLED is constantly maintained by a voltage between a gate and a source of the second TFT NM2.

The storage capacitor Cst is connected between the first node n1 and the ground voltage source GND. The storage capacitor Cst charges a voltage between a gate and a source of the second TFT NM2 for a light emitting period EP to maintain a light-emitting amount of the organic light-emitting diode element OLED. In addition, a gate electrode of the first TFT NM1 is connected to the corresponding one of the scan lines S1 to Sn, and a drain electrode of the first TFT NM1 is connected to the corresponding one of the data lines D1 to Dm. A source electrode of the first TFT NM1 is connected to the first node n1.

The first TFT NM1 is turned-on in response to the first scanning pulse NSCN1 from the corresponding one of the scan lines S1 to Sn at an initial scanning period of a light emitting period EP of a frame period. Thus, the first TFT NM1 forms a current path between the corresponding one of the data lines D1 to Dm and the first node n1 to supply a data voltage Vdata to the first node n1. In addition, the first TFT NM1 is turned-on in response to the second scanning pulse NSCN2 from the corresponding one of the scan lines S1 to Sn at an initial scanning period of a black data inserting period BP of the frame period. Thus, the first TFT NM1 forms a current path between the corresponding one of data lines D1 to Dm and the first node n1 to supply a reset voltage Vrst to the first node n1.

The second TFT NM2 is a driving TFT, and allows a current to flow into an organic light-emitting diode element OLED in accordance with a data voltage. The data voltage is supplied to the first node n1 during the light emitting period EP. On the other hands, the second TFT NM2 is turned-off by a reset voltage Vrst to cut off a current of the organic light-emitting diode element OLED. Herein, the reset voltage Vrst is supplied to the first node n1 during the black data inserting period BP. A gate electrode of the second TFT NM2 is connected to the first node n1, and a drain electrode of the second TFT NM2 is connected to a cathode electrode of the organic light-emitting diode element OLED. A source electrode of the second TFT NM2 is connected to the ground voltage source GND.

During an initial scanning time of the light emitting period EP, the first scanning pulse NSCN1 is generated by a high-level scanning voltage to boost a potential of a selected one of first scan lines S1 to Sn to a high-level scanning voltage, and a data voltage is supplied to the corresponding one of data lines D1 to Dm by the data driving device 202 (shown in FIG. 8). Accordingly, the first TFT NM1 is turned-on by a high-level scanning voltage during the light emitting period EP of the frame period to supply an analog data voltage Vdata corresponding to a video data to the first node n1. Simultaneously, the storage capacitor Cst stores a voltage of the first node N1, that is, the data voltage Vdata, and the second TFT NM2 is turned-on by a data voltage at the first node n1. Thus, it becomes possible to flow a current into the organic light-emitting diode element OLED.

During the black data inserting period BP, the second scanning pulse NSCN2 of a high-level scanning voltage is supplied to the selected one of the scan lines S1 to Sn, and, at the same time a lowest-level analog gamma voltage corresponding to a black data or a low-level reset voltage Vrst less than thereof is supplied to the corresponding one of the data lines D1 to Dm. Thus, the first TFT NM1 is turned-on by the second scanning pulse NSCN2 to supply the low-level reset voltage Vrst to the first node n1. As a result, the second TFT NM2 is turned-off and initialized by the low-level reset voltage Vrst. Herein, the low-level reset voltage Vrst is applied to the gate electrode of the second TFT NM2. Thus, a current and a light-emitting amount of an organic light-emitting diode element OLED become '0'.

Figure 28:
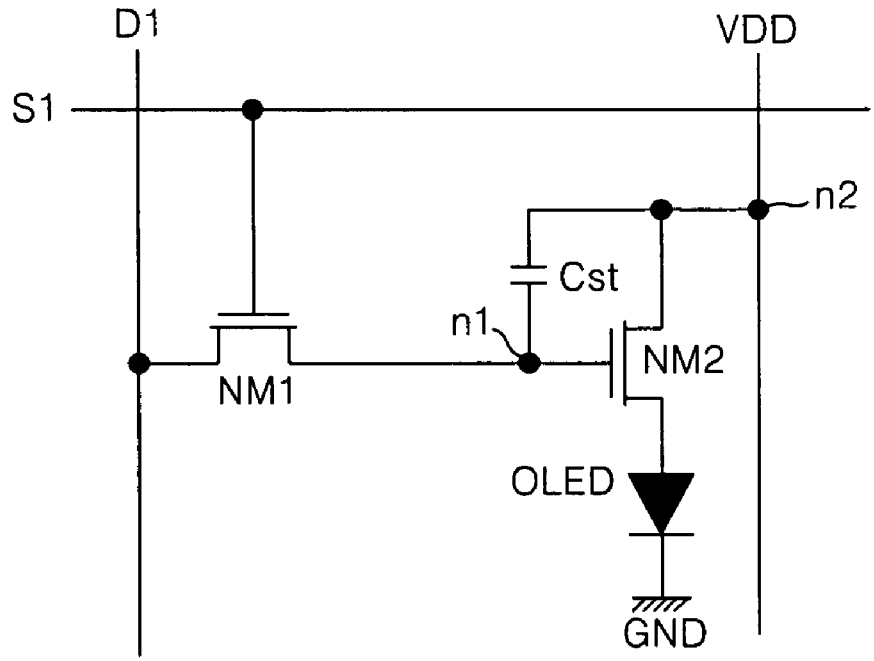
FIGS. 28 to 30 are schematic diagrams illustrating a pixel of the organic light-emitting diode display device shown in FIG. 20 according to embodiments of the invention, respectively.
Figure 29:
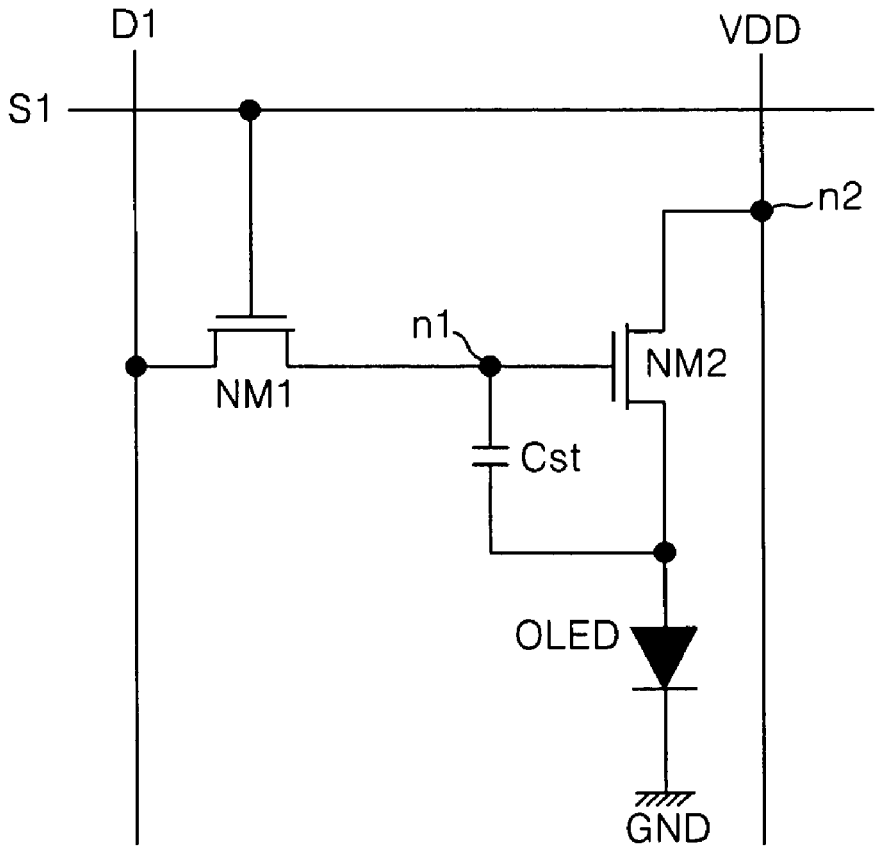
Figure 30:
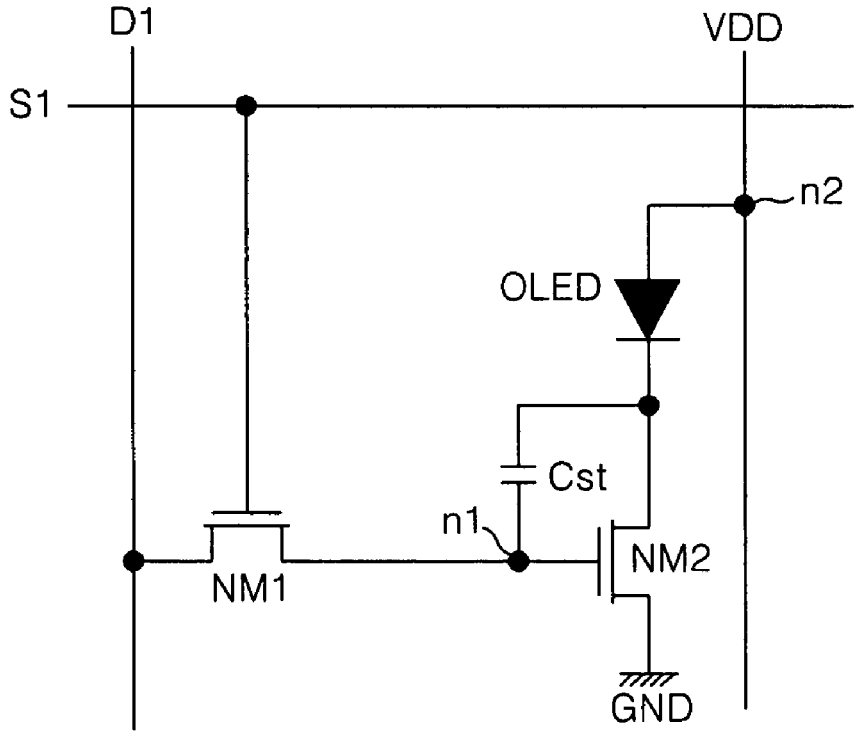

FIGS. 28 to 30 are schematic diagrams illustrating a pixel of the organic light-emitting diode display device shown in FIG. 20 according to embodiments of the invention, respectively. As shown in FIG. 28, a pixel according to an embodiment of the invention alternatively may have a configuration having an anode electrode of the organic light-emitting diode element OLED connected to a source electrode of the second TFT NM2, and a cathode electrode thereof connected to a ground voltage source GND. The storage capacitor Cst is connected between a first node n1 and a second node n2. A gate electrode of the second TFT NM2 is connected to the first node n1, and a drain electrode of the second TFT NM2 is connected to the second node n2. The pixel may be driven by the driving waveform shown in FIG. 27.

Alternatively, as shown in FIG. 29, a pixel according to an embodiment of the invention may have a configuration having a storage capacitor Cst connected between a first node n1 and an anode electrode of the organic light-emitting diode element OLED. The pixel also may be driven by the driving waveform shown in FIG. 27.

As shown in FIG. 30, a pixel according to an embodiment of the invention alternatively may have a storage capacitor Cst connected between a first node n1 and an cathode electrode of an organic light-emitting diode element OLED. Such a pixel also may be driven by the driving waveform shown in FIG. 27.

Accordingly, according to an embodiment of the invention, a current flowing into an organic light-emitting diode element OLED is only defined by a voltage between a gate electrode and a source electrode of a driving TFT. For example, in a pixel driving circuit shown in one of FIG. 9, FIG. 12, FIG. 18, FIG. 19, FIG. 21, FIG. 23, FIG. 26, and FIG. 30, a current flowing into the organic light-emitting diode element OLED is only defined by a voltage between a gate electrode and a source electrode of a driving TFT. Thus, such a pixel driving circuit is a current source circuit that is capable of constantly flowing a current of the organic light-emitting diode element OLED irregardless of characteristics of the organic light-emitting diode element OLED (for example, a threshold voltage).

In addition, in a pixel driving circuit shown in one of FIG. 13, FIG. 15, FIG. 16, FIG. 17, FIG. 24, FIG. 25, FIG. 28, and FIG. 29, a voltage is generated at a source electrode of a TFT (source follower) and is in proportion to a gate voltage. Such a pixel driving circuit allows a current to flow into the organic light-emitting diode element OLED by a difference voltage between a voltage and a high-level driving voltage source VDD, or by a difference voltage between the voltage and a ground voltage GND.

Figure 31:
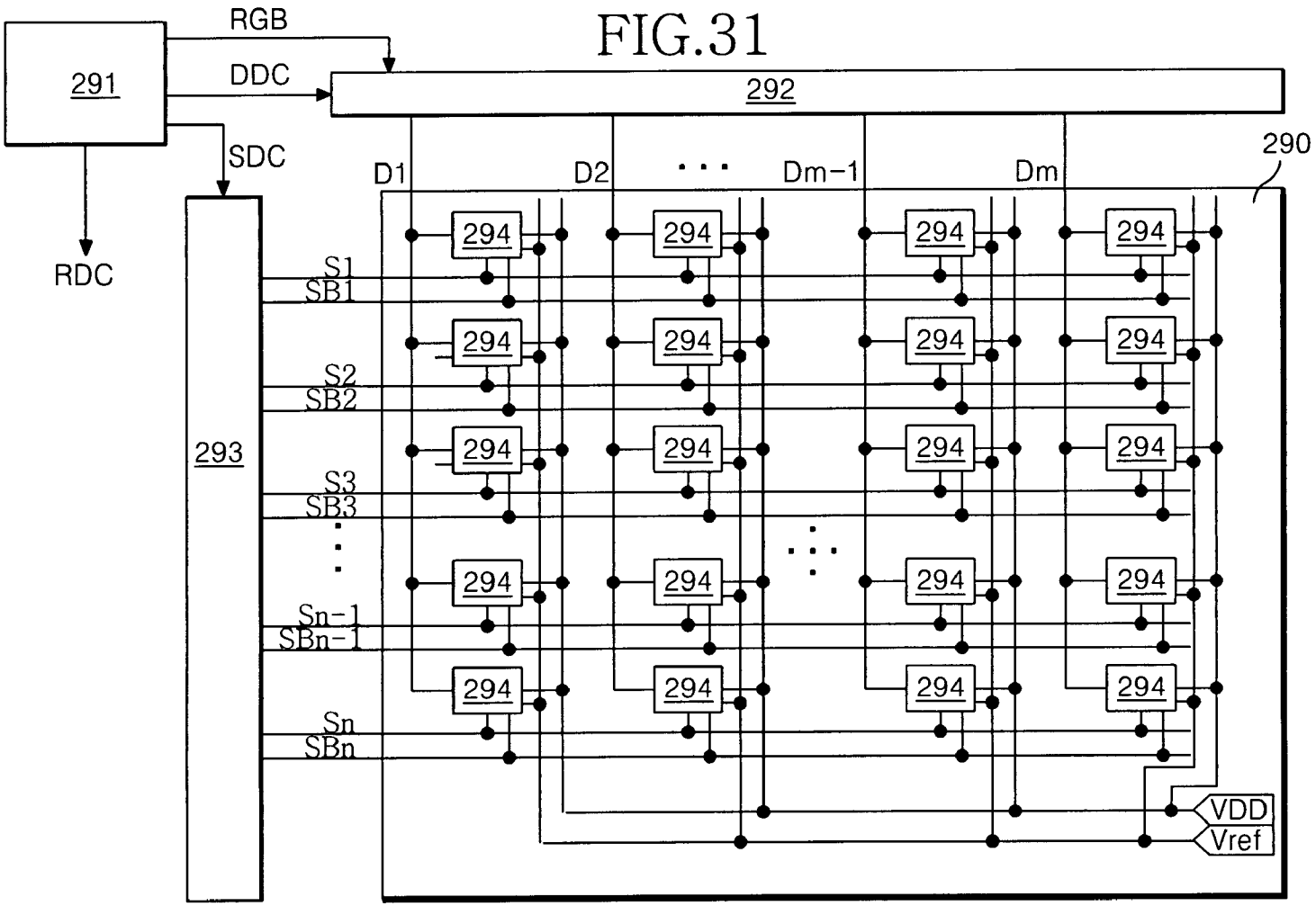
FIG. 31 is a block diagram illustrating an organic light-emitting diode display device according to another embodiment of the invention.

FIG. 31 is a block diagram illustrating an organic light-emitting diode display device according to another embodiment of the invention. In FIG. 31, an organic light-emitting diode display device includes a display panel 290, a data driving device 292, a scan driving device 293, and a timing controller 291. The display panel 290 has m data lines DL1 to DLm, n non-inverted scan lines S1 to Sn, n inverted scan lines SB1 to SBn, and m×n pixels 294. The data driving device 292 alternatively supplies a data voltage and a reset voltage to the data lines DL1 to DLm. The scan driving device 293 sequentially supplies first and second non-inverted scanning pulses to the non-inverted scan lines S1 to Sn, and sequentially supplies first and second inverted scanning pulses to the inverted scan lines SB1 to SBn. The timing controller 291 controls the data driving device 292 and the scan driving device 293.

In addition, the pixels 294 are formed at pixel areas, defined by an intersection of the scan lines (S1 to Sn and SB1 to SBn) and the data lines D1 to Dm. Signal lines also are formed at the display panel 290, and the signal lines are connected to a reference voltage source Vref, a high-level driving voltage source VDD and a ground voltage GND and to each of the pixels 294.

The data driving device 292 converts digital video data RGB from the timing controller 291 into an analog gamma compensation voltage. The data driving device 292 also supplies a data voltage to the data lines DL1 to DLm in response to a data control signal DDC from the timing controller 291 during a scanning period of a programming period. The data voltage may be an analog gamma compensation voltage, and the data voltage is in synchronization with the first non-inverting scanning pulse and the first inverted scanning pulse.

The data driving device 292 also supplies a reset voltage to the data lines D1 to Dm during a scanning period of a reset period. The reset voltage is applied in synchronization with the second non-inverted pulse and the second inverted scanning pulse.

During a scanning period of a programming period, the scan driving device 293 sequentially supplies the first non-inverted scanning pulse in response to a scan control signal SDC from the timing controller 291 to the non-inverted scan lines S1 to Sn. The scan driving device 293 also at the same time, sequentially supplies the first inverted scanning pulse to the inverted scan lines SB1 and SBn. In particular, the first non-inverted scanning pulse and the first inverted scanning pulse are applied in synchronization with the data voltage. The first inverted scanning pulse may be inversed in a reverse phase or by 180 degrees against the first non-inverted scanning pulse.

Moreover, during a scanning period of a reset period, the scan driving device 293 sequentially supplies the second non-inverted scanning pulse to the non-inverted scan lines S1 to Sn and, at the same time, supplies the second inverted scanning pulse to the inverted scan lines SB1 to SBn. The second non-inverted scanning pulse and the second inverted scanning pulse are applied in synchronization with the reset voltage. The second inverted scanning pulse may be inversed in a reverse phase or by 180 degrees against the second non-inverted scanning pulse.

The timing controller 291 generates the control signals DDC and SDC. The timing controller 291 also supplies digital video data RGB to the data driving device 292 and controls an operating time of the scan driving device 293 and the data driving device 292 in accordance with a vertical/horizontal synchronizing signal and a clock signal. Each of the pixels 294 includes the organic light-emitting diode element OLED, four TFTs, and one storage capacitor. Each of the pixels 294 may have a configuration as shown in one of FIG. 32 and FIG. 34.

Figure 32:
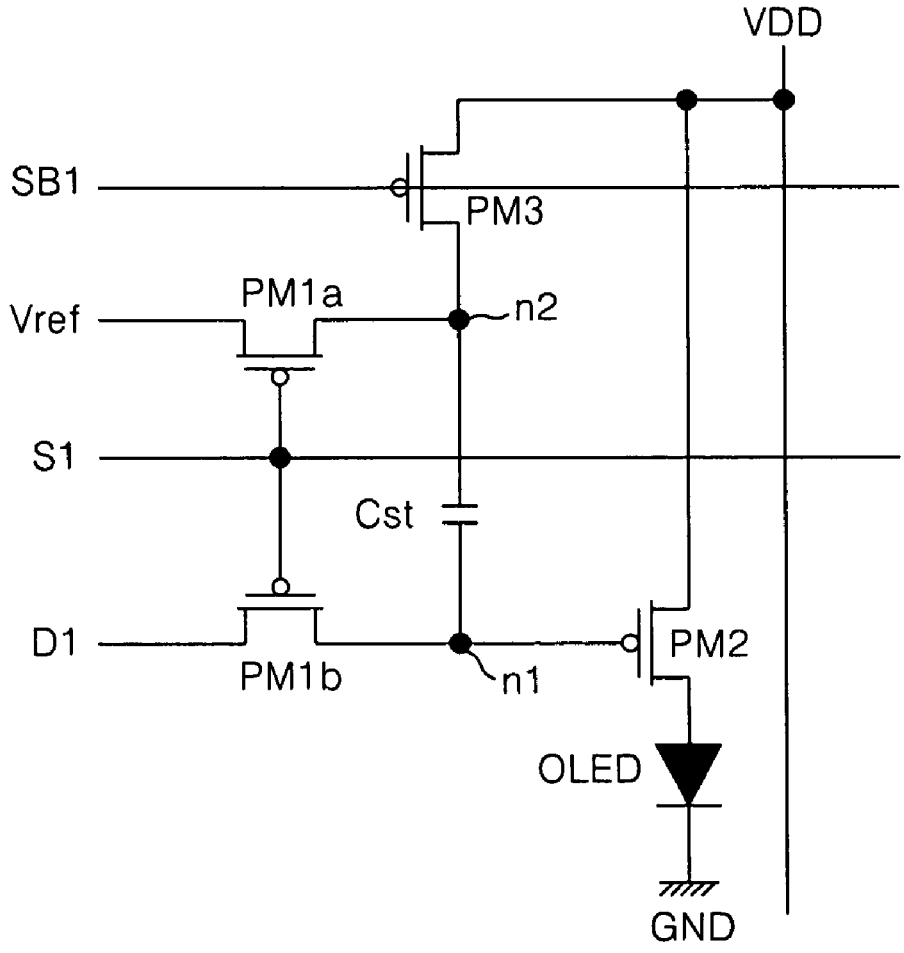
FIG. 32 is a schematic diagram illustrating a pixel of the organic light-emitting diode display device shown in FIG. 31 according to an embodiment of the invention.
Figure 33:
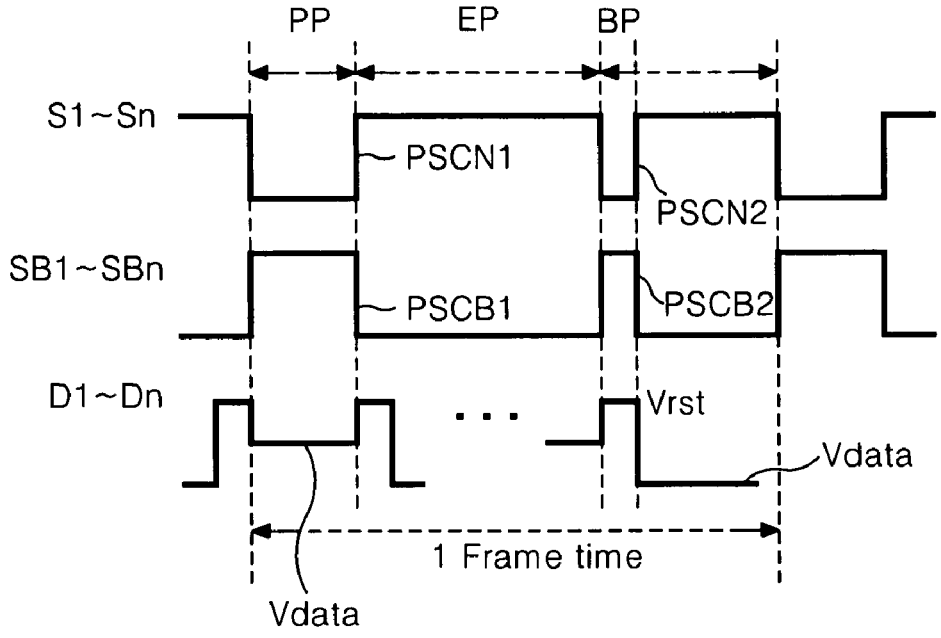
FIG. 33 is a waveform diagram illustrating an exemplary driving waveform for the pixel shown in FIG. 32.

FIG. 32 is a schematic diagram illustrating a pixel of the organic light-emitting diode display device shown in FIG. 31 according to an embodiment of the invention, and FIG. 33 is a waveform diagram illustrating an exemplary driving waveform for the pixel shown in FIG. 32. Referring to FIG. 32 and FIG. 33, a pixel includes an organic light-emitting diode element OLED, a storage capacitor Cst, a first a TFT PM1*a*, a first b TFT PM1*b*, a second TFT PM2, and a third TFT PM3. The storage capacitor is provided between a first node n1 and a second node n2. The first a TFT PM1*a* is turned-on by the non-inverted first and second scanning pulses PSCN1 and PSCN2 to form a current path between a reference voltage supply line and the second node n2. The first b TFT PM1*b* forms a current path between data lines D1 to Dm and the first node n1 in response to the non-inverted scanning pulses PSCN1 and PSCN2. The second TFT PM2 adjusts a current of an organic light-emitting diode element OLED in accordance with a voltage at the first node n1. The third TFT PM3 is turned-off by the inverted scanning pulses PSCB1 and PSCB2 to cut off a current path between a high-level driving voltage supply line and the second node n2. The first to the third TFTs PM1*a* to PM3 are P-type MOS-FETs, and have an amorphous silicon semiconductor layer or a poly silicon semiconductor layer.

In the organic light-emitting diode element OLED, an anode electrode is connected to a drain electrode of second TFT PM2, and a cathode electrode is connected to a ground voltage source GND. In addition, the storage capacitor Cst is connected between the first node n1 and the second node n2. The first a TFT PM1*a* is turned-on by the first non-inverted scanning pulse PSCN1 during a programming period PP of a frame period to supply a reference voltage Vref to the second node n2, and then the first a TFT PM1*a* is turned-off during a light emitting period EP of the frame period. Further, the first a TFT PM1*a* is again turned-on by the second non-inverted scanning pulse PSCN2 during a black data inserting period BP to supply a reset voltage Vrst to the second node n2. A gate electrode of the first a TFT PM1*a* is connected to a corresponding one of the non-inverted scan lines S1 to Sn, and a source electrode of the first a TFT PM1*a* is connected to a reference voltage supply line. A drain electrode of the first a TFT PM1*a* is connected to the second node n2.

The first b TFT PM1*b* is simultaneously turned-on/turned-off with the first a TFT PM1*a* by the first and second non-inverted scanning pulses PSCN1 and PSCN2 to alternately supply the data voltage Vdata and the reset voltage Vrst from the corresponding one of the data lines D1 to Dm to the first node n1. The gate electrode of the first b TFT PM1*b* is connected to the corresponding one of the non-inverted scan lines S1 to Sn, and a source electrode of the first b TFT PM1*b* is connected to the corresponding one of the data lines D1 to Dm. A drain electrode of the first b TFT PM1*b* is connected to the first node n1.

The second TFT PM2 allows a current to flow into an organic light-emitting diode element OLED in accordance with a voltage at the first node n1 during the light emitting period EP. The second TFT PM2 is turned-off by the reset voltage Vrst during the black data inserting period BP to cut off a current path of the organic light-emitting diode element OLED. The reset voltage Vrst is applied to the first node n1. A gate electrode of the second TFT PM2 is connected to the first node n1, and a source electrode of the second TFT PM2 is connected to a high-level driving voltage source VDD. A drain electrode of the second TFT PM2 is connected to the anode electrode of the organic light-emitting diode element OLED.

The third TFT PM3 is turned-off by the first inverted scanning pulse PSCB1 during the programming period PP to cut off a current path between the high-level driving voltage source VDD and the second node n2. The third TFT PM3 is turned-on by a low-level scanning voltage from the corresponding one of the inverted scan lines SB1 and SBn during a light emitting period EP to supply the high-level driving voltage source VDD to the second node n2. Next, the third TFT PM3 is turned-off by the second inverted scanning pulse PSCB2 during the black data inserting period BP. The third TFT PM3 is turned-on when a voltage of the second inverted scanning pulse PSCB2 is changed into the low-level scanning voltage to convert a voltage of the inverted scan lines SB1 and SBn into the low-level scanning voltage. As a result, the third TFT PM3 supplies the high-level driving voltage source VDD to the second node n2.

The pixel 294 can reduce a residual image phenomenon and a motion blurring phenomenon caused by a driving TFT having a hysteresis characteristic. In addition, the pixel 294 minimizes an effect of a high-level driving voltage source VDD at a current of an organic light-emitting diode element OLED to prevent a picture quality deterioration.

During the programming period PP of a frame period, the first non-inverted scanning pulse PSCN1 of a low-level scanning voltage is supplied to the selected one of the non-inverted scan lines S1 to Sn, and a first inverted scanning pulse PSCB1 of a high-level non-scanned voltage is supplied to the selected one of inverted scan lines SB1 to SBn. The data voltage Vdata is supplied to data lines D1 to Dm. Thus, the data voltage Vdata is applied in synchronization with the first non-inverted scanning pulse PSCN1.

Thus, during the programming period PP, the first a and first b TFTs PM1*a* and PM1*b* are turned-on by the low-level scanning voltage of the non-inverted scan lines S1 to Sn, and the third TFT PM3 is turned-off by the high-level non-scanned voltage of the inverted scan lines SB1 to SBn. Accordingly, the second node n2 is charged with a reference voltage Vref, and the first node n1 is charged with the data voltage Vdata. As a result, a voltage of the first node and the second node n1 and n2 for the programming period is Vn1=Vdata and Vn2=Vref, respectively, where 'Vn1' representing a voltage of the first node n1 and 'Vn2' representing a voltage of the second node n2. In addition, the storage capacitor Cst charges a difference voltage between the data voltage Vdata and the reference voltage Vref.

During the light emitting period EP, a potential of the non-inverted scan lines S1 to Sn is inversed into a high-level non-scanned voltage, and a potential of the inverted scan lines SB1 to SBn is inversed into a low-level scanning voltage. Thus, during light emitting period EP, the first a and first b TFTs PM1*a* and PM1*b* are turned-off by the high-level non-scanned voltage of the non-inverted scan lines S1 to Sn, and the third TFT PM3 is turned-on by the low-level scanning voltage of the inverted scan lines SB1 to SBn. Accordingly, a high-level driving voltage source VDD is supplied to the second node n2, and a voltage of the storage capacitor Cst is boot-strapped. Accordingly, voltages at the first node and the second node are Vn1=VDD+Vdata−Vref and Vn2=VDD, respectively, during the light emitting period EP. As a result, a current $I_{OLED}$ of an organic light-emitting diode element OLED is as the following Equation 1. Herein, the flow of the current $I_{OLED}$ is controlled by the second TFT PM2.

$$I_{OLED} = \frac{k}{2}\frac{W}{L}(Vref - Vdata - |Vth|)^2 \quad \text{[Equation 1]}$$

'Vth' represents a threshold voltage of the second TFT PM2, 'k' represents a constant defined by mobility and a parasitic capacitance of the second TFT PM2, 'L' represents a channel length of the second TFT PM2, and 'W' represents a channel width of the second TFT PM2.

Referring to the Equation 1, in the organic light-emitting diode display according to an embodiment of the invention, a current $I_{OLED}$ flowing into an organic light-emitting diode element OLED is not dependent on a high-level driving voltage source VDD. Thus, the current $I_{OLED}$ flowing into the organic light-emitting diode element OLED for a light emitting period EP is not affected by the high-level driving voltage source VDD.

During an initial scanning period of a black data inserting period BP, a potential of the non-inverted scan lines S1 to Sn is again inversed into a low-level scanning voltage by a second non-inverted scanning pulse PSCN2, and a potential of the inverted scan lines SB1 to SBn is again inversed into a high-level non-scanned voltage by the second non-inverted scanning pulse PSCN2. In addition, data lines are supplied with a reset voltage Vrst.

Thus, during the initial scanning period of the black data inserting period BP, the first a and first b TFTs PM1*a* and PM1*b* are turned-on by the low-level scanning voltage, and the third TFT PM3 is turned-off by the high-level non-scanned voltage. The low-level scanning voltage is applied to the gate electrode of the first a and first b TFTs PM1*a* and PM1*b*, and the high-level non-scanned voltage is applied to the gate electrode of the third TFT PM3. Accordingly, a voltage at the first node n1 becomes Vn1=Vrst, and a voltage at the second node n2 becomes Vn2=Vref during the initial scanning period of the black data inserting period BP.

Next, during the black data inserting period BP, a voltage at the first node n1 is changed to Vn1=Vrst+VDD−Vref by a potential inversion of the non-inverted scan lines S1 to Sn and the inverted scan lines SB1 to SBn, and a voltage at the second node n2 is changed into Vn2=VDD by a potential inversion of the non-inverted scan lines S1 to Sn and the inverted scan lines SB1 to SBn. Thus, the second TFT PM2 is turn-off because of "Vrst+VDD−Vref," with "Vrst+VDD−Vref" being increased enough not to cause a light emission at the organic light-emitting diode element OLED.

Figure 34:
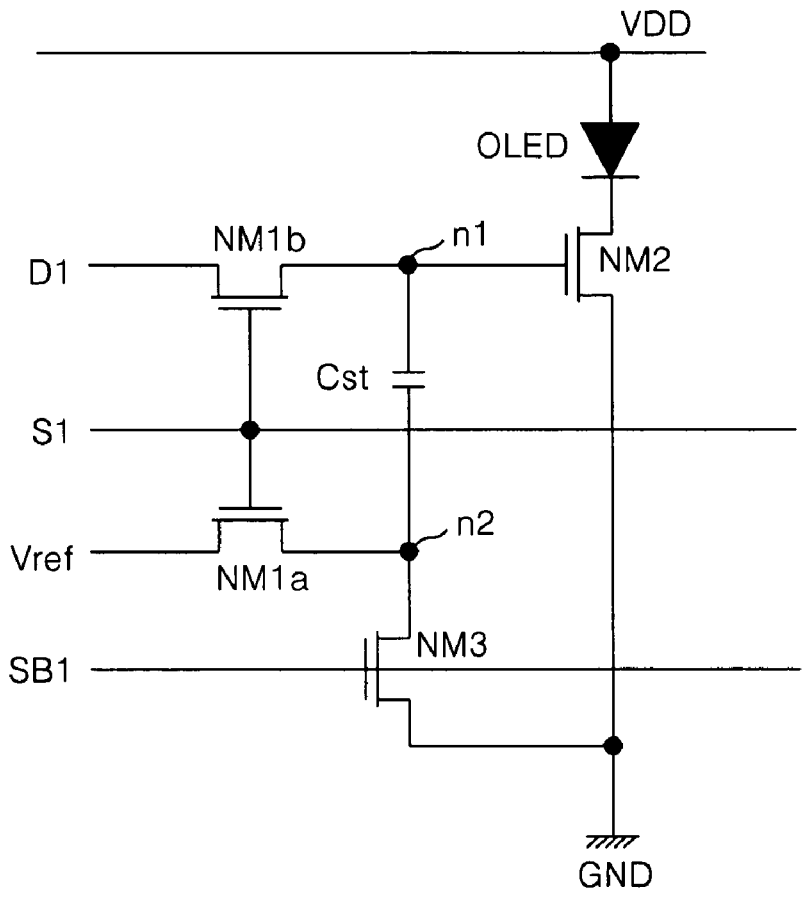
FIG. 34 is a schematic diagram illustrating a pixel of the organic light-emitting diode display device shown in FIG. 31 according to another embodiment of the invention.
Figure 35:
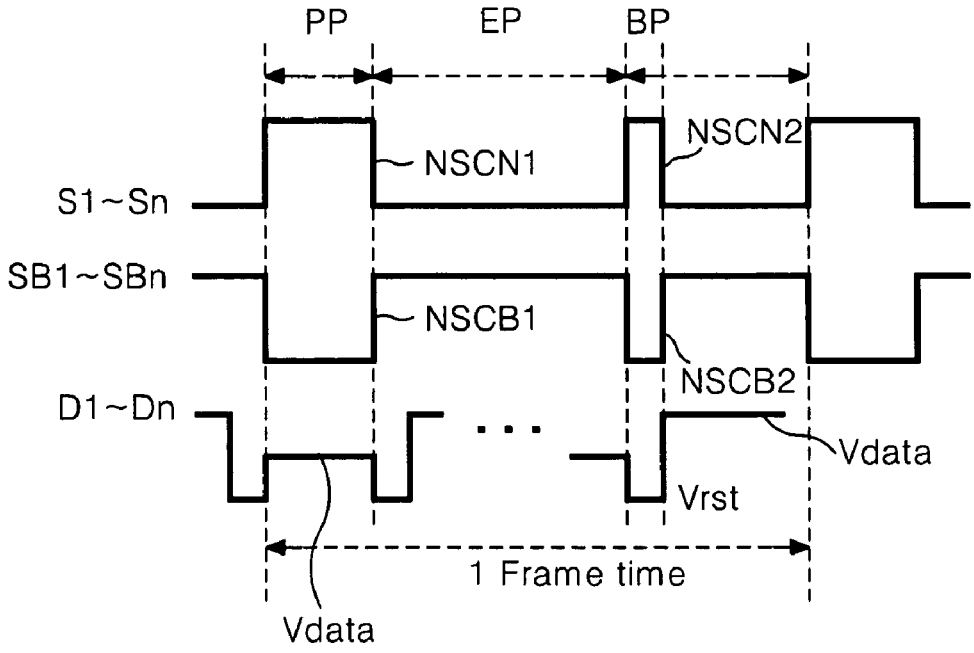
FIG. 35 is a waveform diagram illustrating an exemplary driving waveform for the pixel shown in FIG. 34.

FIG. 34 is a schematic diagram illustrating a pixel of the organic light-emitting diode display device shown in FIG. 31 according to another embodiment of the invention, and FIG. 35 is a waveform diagram illustrating an exemplary driving waveform for the pixel shown in FIG. 34. Referring to FIG. 34 and FIG. 35, the pixel 294 includes an organic light-emitting diode element OLED, a storage capacitor Cst, a first a TFT NM1*a*, a first b TFT NM1*b*, a second TFT NM2, and a third TFT NM3.

The storage capacitor Cst is provided between a first node n1 and a second node n2. The first a TFT NM1*a* is turned-on by non-inverted first and second scanning pulses NSCN1 and NSCN2 to form a current path between a reference voltage supply line and the second node n2. The first b TFT NM1*b* forms a current path between data lines D1 to Dm and the first node n1 in response to the non-inverted first and second scanning pulses NSCN1 and NSCN2. The second TFT NM2 adjusts a current of the organic light-emitting diode element OLED in accordance with a voltage at the first node n1. The third TFT NM3 is turned-off by first and second inverted scanning pulses NSCB1 and NSCB2 to cut off a current path between a ground voltage source GND and the second node n2. The first to third TFTs NM1*a* to NM3 are N-type MOSFETs and may have an amorphous silicon semiconductor layer or a poly silicon semiconductor layer.

In the organic light-emitting diode element OLED, an anode electrode is connected to a high-level driving voltage source VDD, and a cathode electrode is connected to a drain electrode of the second TFT NM2. The first a TFT NM1*a* is turned-on by the first non-inverted scanning pulse NSCN1 during a programming period PP of a frame period to supply a reference voltage Vref to the second node n2, and then the first a TFT NM1*a* is turned-off during a light emitting period EP. The first a TFT NM1*a* is again turned-on by the second non-inverted scanning pulse NSCN2 during a black data inserting period BP to supply a reset voltage Vrst to the second node n2. A gate electrode of the first a TFT NM1*a* is connected to non-inverted scan lines S1 to Sn, and a drain electrode of the first a TFT NM1*a* is connected to a reference voltage supply line. A source electrode of the first a TFT NM1*a* is connected to the second node n2.

The first b TFT NM1*b* is simultaneously turned-on/turned-off with the first a TFT NM1*a* by the first and second non-inverted scanning pulses NSCN1 and NSCN2 to alternately supply a data voltage Vdata and the reset voltage Vrst from data lines D1 to Dm to the first node n1. A gate electrode of the first b TFT NM1*b* is connected to the non-inverted scan lines S1 to Sn, and a drain electrode of the first b TFT NM1*b* is connected to data lines D1 to Dm. A source electrode of the first b TFT NM1*b* is connected to the first node n1.

The second TFT NM2 allows a current to flow into the organic light-emitting diode element OLED in accordance with a voltage at the first node n1 during a light emitting period EP. The second TFT NM2 is turned-off by the reset voltage Vrst to cut off a current path of the organic light-emitting diode element OLED. The reset voltage Vrst is applied to the first node n1 during the black data inserting period BP. A gate electrode of the second TFT NM2 is connected to the first node n1, and a drain electrode of the second TFT NM2 is connected to the cathode electrode of the organic light-emitting diode element OLED. A source electrode of the second TFT NM2 is connected to a ground voltage source GND.

The third TFT NM3 is turned-off by the first inverted scanning pulse NSCB1 during the programming period PP to cut off a current path between a ground voltage source GND and the second node n2. The third TFT NM3 is turned-on by a high-level scanning voltage from the inverted scan lines SB1 and SBn during the light emitting period EP to supply the ground voltage GND to the second node n2. Next, the third TFT NM3 is turned-off by the second inverted scanning pulse NSCB2 during the black data inserting period BP, and then the third TFT NM3 is turned-on when a voltage of the second inverted scanning pulse NSCB2 is changed into a high-level scanning voltage to convert a voltage of the inverted scan lines SB1 and SBn into the high-level scanning voltage. As a result, the third TFT NM3 supplies the ground voltage GND to the second node n2.

The pixel 294 can reduce a residual image phenomenon and a motion blurring phenomenon. In this case, the residual image phenomenon is generated by a driving TFT having a hysteresis, and the motion blurring phenomenon is generated at a motion picture. Also, the pixel 294 minimizes an effect of a ground voltage GND at a current of an organic light-emitting diode element OLED to prevent a picture quality deterioration. Herein, the picture quality deterioration is generated by a change of the ground voltage GND.

During a programming period PP, the first non-inverted scanning pulse NSCN1 of a high-level scanning voltage is supplied to the non-inverted scan lines S1 to Sn, and the first inverted scanning pulse NSCB1 of a low-level non-scanned voltage is supplied to the inverted scan lines SB1 to SBn. In addition, the data voltage Vdata is supplied to the data lines D1 to Dm. Thus, the data voltage is applied in synchronization with the first non-inverted scanning pulse NSCN1. Thus, during the programming period PP, the first a and first b TFTs NM1*a* and NM1*b* are turned-on by the high-level scanning voltage of the non-inverted scan lines S1 to Sn, and the third TFT NM3 is turned-off by the low-level electric non-scanned voltage of the inverted scan lines SB1 to SBn. Accordingly, the second node n2 is charged with a reference voltage Vref, and the first node n1 is charged with the data voltage Vdata. Herein, the reference voltage Vref is less than a ground voltage GND.

During a light emitting period EP, a potential of the non-inverted scan lines S1 to Sn is inversed into a low-level non-scanned voltage, and a potential of the inverted scan lines SB1 to SBn is inversed into a high-level scanning voltage. During the light emitting period EP, the first a and first b TFTs NM1*a* and NM1*b* are turned-off by the low-level non-scanned voltage of the non-inverted scan lines S1 to Sn, and the third TFT NM3 is turned-on by the high-level scanning voltage of the inverted scan lines SB1 to SBn. Accordingly, the ground voltage GND is supplied to the second node n2, and a voltage of the storage capacitor Cst is boot-strapped. Voltages at the first and second nodes n1 and n2 are Vn1=Vdata+GND+Vref and Vn2=GND, respectively, during the light emitting period EP. As a result, a current $I_{OLED}$ of an organic light-emitting diode element OLED is as the following Equation 2. Herein, the flow of the current $I_{OLED}$ is controlled by the second TFT PM2.

$$I_{OLED} = \frac{k}{2}\frac{W}{L}(Vdata - Vref - |Vth|)^2 \quad \text{[Equation 2]}$$

'Vth' represents a threshold voltage of the second TFT NM2, 'k' represents a constant defined by mobility and a parasitic capacitance of the second TFT NM2, 'L' represents a channel length of the second TFT NM2, and 'W' represents a channel width of the second TFT NM2.

Referring to the Equation 2, in the organic light-emitting diode display according to an embodiment of the invention, a current $I_{OLED}$ flowing into an organic light-emitting diode element OLED is not dependent on a ground voltage GND. Thus, the current $I_{OLED}$ flowing into the organic light-emitting diode element OLED for a light emitting period EP is not affected by the ground voltage GND.

During an initial scanning period of the black data inserting period BP, a potential of the non-inverted scan lines S1 to Sn is again inversed into a high-level scanning voltage by the second non-inverted scanning pulse NSCN2, and a potential of the inverted scan lines SB1 to SBn is again inversed into a low-level non-scanned voltage by the second non-inverted scanning pulse NSCN2. In addition, data lines are supplied with a reset voltage Vrst. During the initial scanning period of the black data inserting period BP, the first a and first b TFTs NM1*a* and NM1*b* are turned-on by the high-level scanning voltage, and the third TFT NM3 is turned-off by the low-level non-scanned voltage. Thus, the high-level scanning voltage is applied to the gate electrode of the first a and first b TFTs NM1*a* and NM1*b*, and the low-level non-scanned voltage is applied to the third TFT NM3. Accordingly, during the initial scanning period of the black data inserting period BP, a voltage at the first node n1 becomes the reset voltage Vrst, and a voltage at the second node n2 becomes the reference voltage Vref.

Next, during anther period of the black data inserting period BP, a voltage at the first node n1 is changed into Vn1=Vrst−Vref by a potential inversion of the scan lines S1 to Sn and the inverted scan lines SB1 to SBn, and a voltage at the second node n2 is changed into Vn2=GND by a potential inversion of the scan lines S1 to Sn and the inverted scan lines SB1 to SBn. Thus, the second TFT NM2 is turn-off because of "Vrst−Vref," with "Vrst−Vref" being decreased enough not to cause a light emission at the organic light-emitting diode element OLED.

In each of the above-described pixel configurations, the TFTs of one pixel have the same channel characteristics. Alternatively, although not shown, the TFTs of one pixel may have different channel characteristics from one another and may be formed at one pixel by a complementary metal oxide semiconductor ("CMOS") process. In addition, a voltage of scanning pulses may be changed in accordance with a channel characteristics of the N-type MOS-FET and the P-type MOS-FET if an N-type MOS-FET and a P-type MOS-FET are simultaneously formed at one pixel.

Hence, an organic light-emitting diode display device and a driving method thereof according to an embodiment of the invention reduce a residual image phenomenon and a motion blurring phenomenon using switch elements more than two. As a result, an organic light-emitting diode display device and a driving method thereof according to an embodiment of the invention improve brightness uniformity at a large size panel.

It will be apparent to those skilled in the art that various modifications and variations can be made in the organic light-emitting diode display device and the driving method thereof employing the same of embodiments of the invention without departing from the spirit or scope of the invention. Thus, it is intended that embodiments of the invention cover the modifications and variations of this invention provided they come within the scope of the appended claims and their equivalents.

What is claimed is:

1. An organic light-emitting diode display device, comprising:

a driving voltage source providing a driving voltage;

a ground voltage source providing a ground voltage;

a first scan line receiving a first scanning signal;

a second scan line receiving a second scanning signal;

a data line crossing the first and second scan lines;

a first switch element turned-on in response to the first scanning signal during a first period to supply a data from the data line to a first node, and then maintaining an off-state during a second period;

a driving device adjusting a current through an organic light-emitting diode element in accordance with a voltage of the first node;

a reference voltage source providing a reference voltage that is capable of turning-off the driving device;

a second switch element maintaining an off-state during the first period, and turned-on during the second period to supply the reference voltage to the first node; and a storage capacitor maintaining the voltage at the first node.

2. The organic light-emitting diode display device as claimed in claim 1, wherein the organic light-emitting diode element is connected between the driving device and the ground voltage source; and the storage capacitor is connected between the driving voltage source and the first node.

3. The organic light-emitting diode display device as claimed in claim 2, wherein the driving device includes a P-type MOS-FET;

the switch elements includes one of a P-type MOS-FET and an N-type MOS-FET;

the first switch element includes a gate electrode connected to the first scan line, a source electrode connected to the data line, and a drain electrode connected to the first node;

the driving device includes a gate electrode connected to the first node, a source electrode connected to the driving voltage source, and a drain electrode connected to an anode electrode of the organic light-emitting diode element; and the second switch element includes a gate electrode connected to the second scan line, a source electrode connected to the reference voltage source, and a drain electrode connected to the first node.

4. The organic light-emitting diode display device as claimed in claim 1, wherein the storage capacitor is connected between the first node and an anode electrode of the organic light-emitting diode element.

5. The organic light-emitting diode display device as claimed in claim 4, wherein the driving device includes an N-type MOS-FET;

the switch elements include one of a P-type MOS-FET and an N-type MOS-FET;

the first switch element includes a gate electrode connected to the first scan line, a drain electrode connected to the data line, and a source electrode connected to the first node;

the driving device includes a gate electrode connected to the first node, a drain electrode connected to the driving voltage source, and a source electrode connected to an anode electrode of the organic light-emitting diode element; and the second switch element includes a gate electrode connected to the second scan line, a source electrode connected to the reference voltage source, and a drain electrode connected to the first node.

6. The organic light-emitting diode display device as claimed in claim 1, wherein the organic light-emitting diode element is connected between the driving voltage source and the driving device; and the storage capacitor is connected between the first node and the ground voltage source.

7. The organic light-emitting diode display device as claimed in claim 6, wherein the driving device includes a P-type MOS-FET;

the switch elements include one of a P-type MOS-FET and an N-type MOS-FET;

the first switch element includes a gate electrode connected to the first scan line, a source electrode connected to the data line, and a drain electrode connected to the first node;

the driving device includes a gate electrode connected to the first node, a source electrode connected to a cathode electrode of the organic light-emitting diode element, and a drain electrode connected to the ground voltage source; and the second switch element includes a gate electrode connected to the second scan line, a source electrode connected to the reference voltage source, and a drain electrode connected to the first node.

8. The organic light-emitting diode display device as claimed in claim 1, wherein the storage capacitor is connected between the first node and a cathode electrode of the organic light-emitting diode element.

9. The organic light-emitting diode display device as claimed in claim 8, wherein the driving device includes an N-type MOS-FET;

the switch elements include one of a P-type MOS-FET and an N-type MOS-FET;

the first switch element includes a gate electrode connected to the first scan line, a drain electrode connected to the data line, and a source electrode connected to the first node;

the driving device includes a gate electrode connected to the first node, a drain electrode connected to a cathode electrode of the organic light-emitting diode element, and a source electrode connected to the ground voltage source; and the second switch element includes a gate electrode connected to the second scan line, a source electrode connected to the reference voltage source, and a drain electrode connected to the first node.

10. An organic light-emitting diode display device, comprising:

a driving voltage source providing a driving voltage;

a ground voltage source providing a ground voltage;

an organic light-emitting diode element;

a scan line receiving a first scanning signal and a second scanning signal sequentially at an interval;

a data line crossing the scan line and receiving a data voltage and a reset voltage;

a switch element turned-on by the first scanning signal during a first period to supply the data voltage to a first node, and then turned-on by the second scanning signal during a second period to supply the reset voltage to the first node;

a driving device allowing a current to flow into the organic light-emitting diode element in accordance with the data voltage supplied to the first node and turned-off by the reset voltage supplied to the first node; and a storage capacitor maintaining the voltage at the first node.

11. The organic light-emitting diode display device as claimed in claim 10, wherein the organic light-emitting diode element is connected between the driving device and the ground voltage source; and the storage capacitor is connected between the driving voltage source and the first node.

12. The organic light-emitting diode display device as claimed in claim 11, wherein the driving device includes a P-type MOS-FET;

the switch element includes one of a P-type MOS-FET and an N-type MOS-FET;

the switch element includes a gate electrode connected to the scan line, a source electrode connected to the data line, and a drain electrode connected to the first node; and the driving device includes a gate electrode connected to the first node, a source electrode connected to the driving voltage source, and a drain electrode connected to an anode electrode of the organic light-emitting diode element.

13. The organic light-emitting diode display device as claimed in claim 11, wherein the driving device includes an N-type MOS-FET;

the switch element includes one of a P-type MOS-FET and an N-type MOS-FET;

the switch element includes a gate electrode connected to the scan line, a drain electrode connected to the data line, and a source electrode connected to the first node; and the driving device includes a gate electrode connected to the first node, a drain electrode connected to the driving voltage source, and a source electrode connected to an anode electrode of the organic light-emitting diode element.

14. The organic light-emitting diode display device as claimed in claim 10, wherein the organic light-emitting diode element is connected between the driving device and the ground voltage source; and the storage capacitor is connected between the first node and an anode electrode of the organic light-emitting diode element.

15. The organic light-emitting diode display device as claimed in claim 14, wherein the driving device includes a P-type MOS-FET;

the switch element includes one of a P-type MOS-FET and an N-type MOS-FET;

the switch element includes a gate electrode connected to the scan line, a drain electrode connected to the data line, and a source electrode connected to the first node; and the driving device includes a gate electrode connected to the first node, a drain electrode connected to the driving voltage source, and a source electrode connected to an anode electrode of the organic light-emitting diode element.

16. The organic light-emitting diode display device as claimed in claim 10, wherein the organic light-emitting diode element is connected between the driving voltage source and the driving device; and the storage capacitor is connected between the first node and the ground voltage source.

17. The organic light-emitting diode display device as claimed in claim 16, wherein the driving device includes a P-type MOS-FET;

the switch element includes one of a P-type MOS-FET and an N-type MOS-FET;

the switch element includes a gate electrode connected to the scan line, a source electrode connected to the data line, and a drain electrode connected to the first node; and the driving device includes a gate electrode connected to the first node, a source electrode connected to a cathode electrode of the organic light-emitting diode element, and a drain electrode connected to the ground voltage source.

18. The organic light-emitting diode display device as claimed in claim 10, wherein the organic light-emitting diode element is connected between the driving voltage source and the driving device; and the storage capacitor is connected between the first node and a cathode electrode of the organic light-emitting diode element.

19. The organic light-emitting diode display device as claimed in claim 18, wherein the driving device includes a P-type MOS-FET;

the switch element includes one of a P-type MOS-FET and an N-type MOS-FET;

the switch element includes a gate electrode connected to the scan line, a source electrode connected to the data line, and a drain electrode connected to the first node; and the driving device includes a gate electrode connected to the first node, a source electrode connected to a cathode electrode of the organic light-emitting diode element, and a drain electrode connected to the ground voltage source.

20. The organic light-emitting diode display device as claimed in claim 14, wherein the driving device includes an N-type MOS-FET;

the switch element includes one of a P-type MOS-FET and an N-type MOS-FET;

the switch element includes a gate electrode connected to the scan line, a drain electrode connected to the data line, and a source electrode connected to the first node; and the driving device includes a gate electrode connected to the first node, a drain electrode connected to the driving voltage source, and a source electrode connected to an anode electrode of the organic light-emitting diode element.

21. The organic light-emitting diode display device as claimed in claim 16, wherein the driving device includes an N-type MOS-FET;

the switch element includes one of a P-type MOS-FET and an N-type MOS-FET;

the switch element includes a gate electrode connected to the scan line, a drain electrode connected to the data line, and a source electrode connected to the first node; and the driving device includes a gate electrode connected to the first node, a drain electrode connected to the driving voltage source, and a source electrode connected to an anode electrode of the organic light-emitting diode element.

22. The organic light-emitting diode display device as claimed in claim 18, wherein the driving device includes an N-type MOS-FET;

the switch element includes one of a P-type MOS-FET and an N-type MOS-FET;

the switch element includes a gate electrode connected to the scan line, a drain electrode connected to the data line, and a source electrode connected to the first node; and the driving device includes a gate electrode connected to the first node, a drain electrode connected to the driving voltage source, and a source electrode connected to an anode electrode of the organic light-emitting diode element.

23. An organic light-emitting diode display device, comprising:

a driving voltage source providing a driving voltage;

a ground voltage source providing a ground voltage;

a reference voltage source providing a reference voltage;

an organic light-emitting diode element;

a capacitor connected between a first node and a second node;

a first scan line receiving a first scanning signal and a second scanning signal;

a second scan line receiving a first scanning signal and a second scanning signal sequentially at an interval;

a data line crossing the scan lines and receiving a data voltage and a reset voltage;

a first a switch element turned-on by a signal of the first scan line during a first period to supply the reference voltage to the second node, and then turned-off during a second period, and turned-on by a signal of the first scan line during a third period to supply the reference voltage to the second node;

a first b switch element turned-on by a signal of the first scan line during the first period to supply the data voltage to the first node, and then turned-off by a signal of the first scan line during the second period, and turned-on by a signal of the first scan line during the third period to supply the reset voltage to the first node;

a driving device allowing a current to flow into the organic light-emitting diode element in accordance with the data voltage supplied to the first node, and turned-off by the reset voltage supplied to the first node; and a second switch element turned-off by a signal of the second scan line for the first period, and then turned-on for the second time to supply one of the driving voltage and the reference voltage to the second node, and turned-off for the third period.

24. The organic light-emitting diode display device as claimed in claim 23, wherein the organic light-emitting diode element is connected between the driving device and the ground voltage source.

25. The organic light-emitting diode display device as claimed in claim 24, wherein the driving device includes a P-type MOS-FET;

the switch elements include one of a P-type MOS-FET and an N-type MOS-FET;

the first a switch element includes a gate electrode connected to the first scan line, a source electrode connected to the reference voltage source, and a drain electrode connected to the second node;

the first b switch element includes a gate electrode connected to the first scan line, a source electrode connected to the data line, and a drain electrode connected to the first node;

the driving device includes a gate electrode connected to the first node, a source electrode connected to the driving voltage source, and a drain electrode connected to an anode electrode of the organic light-emitting diode element; and the second switch element includes a gate electrode connected to the second scan line, a source electrode connected to the driving voltage source, and a drain electrode connected to the second node.

26. The organic light-emitting diode display device as claimed in claim 23, wherein the organic light-emitting diode element is connected between the driving voltage source and the driving device.

27. The organic light-emitting diode display device as claimed in claim 26, wherein the driving device includes an N-type MOS-FET;

the switch elements include one of a P-type MOS-FET and an N-type MOS-FET;

the first a switch element includes a gate electrode connected to the first scan line, a source electrode connected to the reference voltage source, and a drain electrode connected to the second node;

the first b switch element includes a gate electrode connected to the first scan line, a source electrode connected to the data line, and a drain electrode connected to the first node;

the driving device includes a gate electrode connected to the first node, a source electrode connected to a cathode electrode of the organic light-emitting diode element, and a drain electrode connected to the ground voltage source; and the third switch element includes a gate electrode connected to the second scan line, a source electrode connected to the second node, and a drain electrode connected to the ground voltage source.

28. The organic light-emitting diode display device as claimed in claim 25, wherein the driving device includes an N-type MOS-FET;

the switch elements include one of a P-type MOS-FET and an N-type MOS-FET;

the first a switch element includes a gate electrode connected to the non-inverted scan line, a source electrode connected to the reference voltage source, and a drain electrode connected to the second node;

the first b switch element includes a gate electrode connected to the non-inverted scan line, a drain electrode connected to the data line, and a source electrode connected to the first node;

the driving device includes a gate electrode connected to the first node, a drain electrode connected to the driving voltage source, and a source electrode connected to an anode electrode of the organic light-emitting diode element; and the third switch element includes a gate electrode connected to the inverted scan line, a drain electrode connected to the driving voltage source, and a source electrode connected to the second node.

29. The organic light-emitting diode display device as claimed in claim 27, wherein the driving device includes an N-type MOS-FET;

the switch elements include one of a P-type MOS-FET and an N-type MOS-FET;

the first a switch element includes a gate electrode connected to the non-inverted scan line, a drain electrode connected to the reference voltage source, and a source electrode connected to the second node;

the first b switch element includes a gate electrode connected to the non-inverted scan line, a drain electrode connected to the data line, and a source electrode connected to the first node;

the driving device includes a gate electrode connected to the first node, a drain electrode connected to the driving voltage source, and a source electrode connected to an anode electrode of the organic light-emitting diode element; and the third switch element includes a gate electrode connected to the inverted scan line, a drain electrode connected to the driving voltage source, and a source electrode connected to the second node.

30. The organic light-emitting diode display device as claimed in claim 28, wherein at least two switch elements among the driving device and the switch elements have opposite channel characteristics, and voltages of the scanning signals supplied to the switch elements having different channel characteristics are reversed each other.

31. The organic light-emitting diode display device as claimed in claim 29, wherein at least two switch elements among the driving device and the switch elements have opposite channel characteristics, and voltages of the scanning signals supplied to the switch elements having different channel characteristics are reversed each other.

32. A method of driving an organic light-emitting diode display device, including an organic light-emitting diode element, a driving voltage source providing a driving voltage, a ground voltage source providing a ground voltage, a driving device adjusting a current of the organic light-emitting diode element in accordance with a voltage of a first node, and to which the driving voltage is supplied via a second node, a storage capacitor connected between the first node and the second node, a data line receiving a data voltage, and a scan line crossing the data line and receiving a scanning signal, the method comprises:

supplying a first scanning signal to a first scan line during a first period to turn-on a first switch element connected between the data line and the first node to supply the data voltage to the first node; and turning-off the first switch element, and supplying a second scanning signal to a second scan line during a second period to turn-on a second switch element connected between a reference voltage source generating a reference voltage that is capable of turning-off the driving device and the first node to supply the reference voltage to the first node.

33. A method of driving an organic light-emitting diode display device, including an organic light-emitting diode element, a driving voltage source providing a driving voltage, a ground voltage source providing a ground voltage, a driving device adjusting a current of the organic light-emitting diode element in accordance with a voltage of a first node, and to which the driving voltage is supplied via a second node, a storage capacitor connected between the first node and the second node, a data line receiving a data voltage, and a scan line crossing the data line and receiving a scanning signal, the method comprises:

supplying the data voltage to the data line during a first period, and then supplying a reset voltage that is capable of turning-off the driving device to the data line during a second period;

supplying a first scanning signal to the scan line during the first period to turn-on a first switch element connected between the data line and the first node to supply the data voltage to a first node; and supplying a second scanning signal to the scan line during the second period to supply the reset voltage to the first node.

34. A method of driving an organic light-emitting diode display device, including an organic light-emitting diode element, a driving voltage source providing a driving voltage, a ground voltage source providing a ground voltage, a driving device adjusting a current of the organic light-emitting diode element in accordance with a voltage of a first node, and to which the driving voltage is supplied via a second node, and a storage capacitor connected between the first node and the second node, the method comprises:

sequentially supplying a data voltage, and a reset voltage that is capable of turning-off the driving device to the data line;

supplying a scanning voltage of a first scanning signal to a first scan line during a first period to turn-on a first a switch element connected between a reference voltage source generating a reference voltage and the second node to charge the reference voltage into the second node and, at the same time turning-on a first b switch element connected between the data line and the first node to charge the data voltage into the first node, and supplying a non-scanned voltage of a first inversed scanning signal generated in a reverse phase against the first scanning signal to a second scan line to turn-off a second switch element connected between the driving voltage source and the second node;

supplying a non-scanned voltage of the first scanning signal to the first scan line during a second period to turn-off the first a and first b switch elements and, at the same time supplying a scanning voltage of the first inversed scanning signal to the second scan line to turn-on the second switch element to supply supplying one of the driving voltage and the ground voltage to the second node; and supplying a scanning voltage of a second scanning signal to the first scan line during a third period to turn-on the first a and first b switch elements to supply the reset voltage to the first node, and supplying the reference voltage to the second node and, at the same time supplying a non-scanned voltage of a second inversed scanning signal generated in a reverse phase against the second scanning signal to the second scan line to turn-off the second switch element.

* * * * *